US011233325B2

(12) United States Patent
Greenwood et al.

(10) Patent No.: US 11,233,325 B2
(45) Date of Patent: Jan. 25, 2022

(54) ANTENNA ASSEMBLY

(71) Applicant: Panasonic Avionics Corporation, Lake Forest, CA (US)

(72) Inventors: Martin W. Greenwood, Trabuco Canyon, CA (US); Jignesh M. Sutaria, Irvine, CA (US); Rudy Concepcion, Jr., Rancho Santa Margarita, CA (US); Amir Ali Mirmirani, Mission Viejo, CA (US)

(73) Assignee: PANASONIC AVIONICS CORPORATION, Lake Forest, CA (US)

( * ) Notice: Subject to any disclaimer, the term of this patent is extended or adjusted under 35 U.S.C. 154(b) by 99 days.

(21) Appl. No.: 16/785,475

(22) Filed: Feb. 7, 2020

(65) Prior Publication Data

US 2021/0249767 A1 Aug. 12, 2021

(51) Int. Cl.

| | |
|---|---|
| ***H01Q 25/00*** | (2006.01) |
| ***H01Q 3/04*** | (2006.01) |
| ***H01Q 1/28*** | (2006.01) |
| ***H01Q 3/34*** | (2006.01) |

(52) U.S. Cl.

CPC ..... *H01Q 3/04* (2013.01); *H01Q 1/28* (2013.01); *H01Q 3/34* (2013.01)

(58) Field of Classification Search

CPC ..... H01Q 3/04; H01Q 3/34; H01Q 3/005; H01Q 3/08; H01Q 1/28; H01Q 25/00; H01Q 21/061

See application file for complete search history.

(56) References Cited

U.S. PATENT DOCUMENTS

| | | | | |
|---|---|---|---|---|
| 5,420,598 | A * | 5/1995 | Uematsu | H01Q 1/3275 343/765 |
| 9,647,748 | B1 | 5/2017 | Mitchell | |
| 10,396,444 | B2 | 8/2019 | Levy et al. | |
| 2002/0050946 | A1 | 5/2002 | Chang et al. | |
| 2005/0146473 | A1* | 7/2005 | Stoyanov | H01Q 1/1264 343/753 |
| 2007/0146222 | A1 | 6/2007 | Mansour | |
| 2008/0018545 | A1* | 1/2008 | Kaplan | H01Q 1/3275 343/713 |
| 2016/0164173 | A1* | 6/2016 | Naym | H01Q 21/28 343/760 |
| 2018/0125084 | A1 | 5/2018 | Moyer et al. | |
| 2018/0269576 | A1 | 9/2018 | Scarborough et al. | |

* cited by examiner

*Primary Examiner* — Awat M Salih
(74) *Attorney, Agent, or Firm* — Perkins Coie LLP

(57) ABSTRACT

The present disclosure relates to antenna assemblies and systems and methods for steering an antenna to one or more satellites. An embodiment herein provides for an assembly comprising a rotatable plate rotatable about a first axis to steer the antenna in azimuth; a first panel affixed to the rotatable plate and comprising a first plurality of phased array antenna elements to steer a first beam of radio waves in elevation; and a second panel comprising a second plurality of phased array antenna elements configured to steer a second beam of radio waves in azimuth, wherein rotation of the distal end about the second axis steers the second beam of radio waves in elevation.

16 Claims, 19 Drawing Sheets

ANTENNA ASSEMBLY

BACKGROUND

Technical Field

The present disclosure relates generally to antennas for satellite communication, and more particularly to an antenna assembly for communicating with a plurality of communication systems through a mechanical and electrical steering of antenna elements.

Related Art

One conventional approach to antenna assemblies for satellite communication has been to provide paraboloid shapes, i.e., a dish shape, and point it towards a satellite. This is an efficient and cost-effective solution for ground-based installations, especially for communication with geostationary (GEO) satellites. It has also been satisfactory for some vehicle applications, such as in the maritime industry where vessels travel at relatively low speeds, in which a low profile antenna assembly is not critical for drag reduction. Further, greater weight and power requirements are more easily tolerated for marine surface vessels.

Some attempts have been made to provide paraboloid types of antennas on aircraft. However, the applications have been limited to areas where the antenna can be enclosed behind a radome to reduce drag. This has constrained the size of the antenna assembly, and hence performance. In addition, aircraft move at a much greater rate of speed relative to marine vessels, and difficulties are frequently encountered in maintaining proper orientation of the assembly relative to a satellite, i.e., keeping the assembly pointed towards the satellite. While satisfactory for some military and business applications, other solutions have been attempted for aircraft used for commercial passenger transport, such as planar arrays of antennas configured to cooperatively act together in a phased array.

Instead of a large paraboloid structure for concentrating and directing a signal, a planar antenna array employs a group of smaller antenna elements. In particular, the signals from each element of the array are combined to produce a beam of radio waves having a predefined shape and pointing direction. The beam pointing direction is changed as needed via a control system that adjusts the phase and gain of signals transmitted and received to and from the elements of the array to combine individual signals to shape and direct the beam.

The advantage of planar phased arrays for use on vehicles, especially aircraft, is the low profile of the array. Namely, the arrays can be formed to have a substantially planar surface. However, there are drawbacks, of which a major one is that it requires power to operate the phased array, which results in significant waste heat that must be dissipated. For example, planar phased arrays used for commercial aircrafts may require 1,500 watts and even up to 2,500 watts of heat dissipation. This can be difficult because the radome enclosing the antenna assembly traps heat, and excessive temperatures degrades performance of the array. Moreover, the power required by the phased array results in increased fuel consumption.

Furthermore, as satellites travel relative to the vehicle, the planar antenna array exits a coverage region of one satellite and enters a coverage region of a different satellite, thereby necessitating a handover of the communications. In the past, geostationary orbit satellites were used for communications, and the planar antenna arrays may be in communication with such satellites for extended periods of time, for example, an hour, two hours, or longer. Thus, handovers were infrequent and the power consumption was manageable. However, recently communications are being increasingly provided by low-earth orbit (LEO) satellites and medium-earth orbit (MEO) satellites that are not stationary relative to the earth and travel at high speeds through their respective orbit of the earth, and attempts have been made to use high-altitude pseudo satellites (HAPS) (also referred to as an atmospheric satellite) for providing communications. The increased rate of travel of these satellites results in the vehicle being present in a coverage region of such a satellite for a brief time, for example, a matter of minutes. The result is that handover between satellites is occurring at an increasingly frequent rate. The increased handover rate requires an increased operation of the planar antenna array and power consumption to control the pointing direction of the beam of radio waves. Accordingly, better solutions are desired.

The present disclosure is directed toward overcoming one or more of the problems identified above and/or providing advantages over prior systems.

SUMMARY

An antenna assembly is disclosed herein. The antenna assembly comprises a rotatable plate rotatable about a first axis, wherein rotation of the rotatable plate about the first axis steers the antenna assembly in azimuth; a first panel affixed to the rotatable plate, the first panel comprising a first plurality of phased array antenna elements configured to steer a first beam of radio waves in elevation; a mounting structure adjacent to the first panel, the mounting structure having a proximal end mounted to the rotatable plate, a distal end, and a pivot point between the proximal end and the distal end, the distal end being rotatable about a second axis perpendicular to the first axis at the pivot point; and a second panel disposed at the distal end of the mounting structure, the second panel comprising a second plurality of phased array antenna elements configured to steer a second beam of radio waves in azimuth, wherein rotation of the distal end about the second axis steers the second beam of radio waves in elevation.

In some embodiments, the antenna assembly is configured to steer the first beam of radio waves along a first plane parallel with the first axis, the first plane orthogonal to the first panel and steered in azimuth. In some embodiments, alone or in combination, the antenna assembly is configured to steer the second beam of radio waves along a second plane parallel with the second axis, the second plane orthogonal to the second panel and having an elevation angle determined based on the rotation of the second axis.

In another aspect, a method for steering an antenna assembly to one or more satellite systems is disclosed herein. The method comprises rotating a rotatable plate rotatable about a first axis, wherein rotation of the rotatable plate about the first axis steers the antenna assembly in azimuth; driving a first plurality of phased array antenna elements to steer a first beam of radio waves in elevation, the first plurality of phased array antenna elements positioned on a first panel affixed to the rotatable plate; rotating a second panel about a second axis, perpendicular to the first axis, to steer the second panel in elevation, the second panel disposed on the rotatable plate adjacent to the first panel; and driving a second plurality of phased array antenna elements to steer a second beam of radio waves in azimuth, the second plurality of phased array antenna elements positioned on the second panel.

Other advantages and benefits of the disclosed system and methods will be apparent to one of ordinary skill with a review of the following description.

BRIEF DESCRIPTION OF THE DRAWINGS

The details of embodiments of the present disclosure, both as to their structure and operation, can be gleaned in part by study of the accompanying drawings, in which like reference numerals refer to like parts, and in which.

The various features of the present disclosure will now be described with reference to the drawings of the various aspects disclosed herein. In the drawings, the same components may have the same reference numerals. Note that the drawings are not intended to be to scale or show actual quantities of components or relative sizes. The illustrated aspects are intended to illustrate, but not to limit the present disclosure. The drawings include the following Figures.

DETAILED DESCRIPTION

Figure 1:
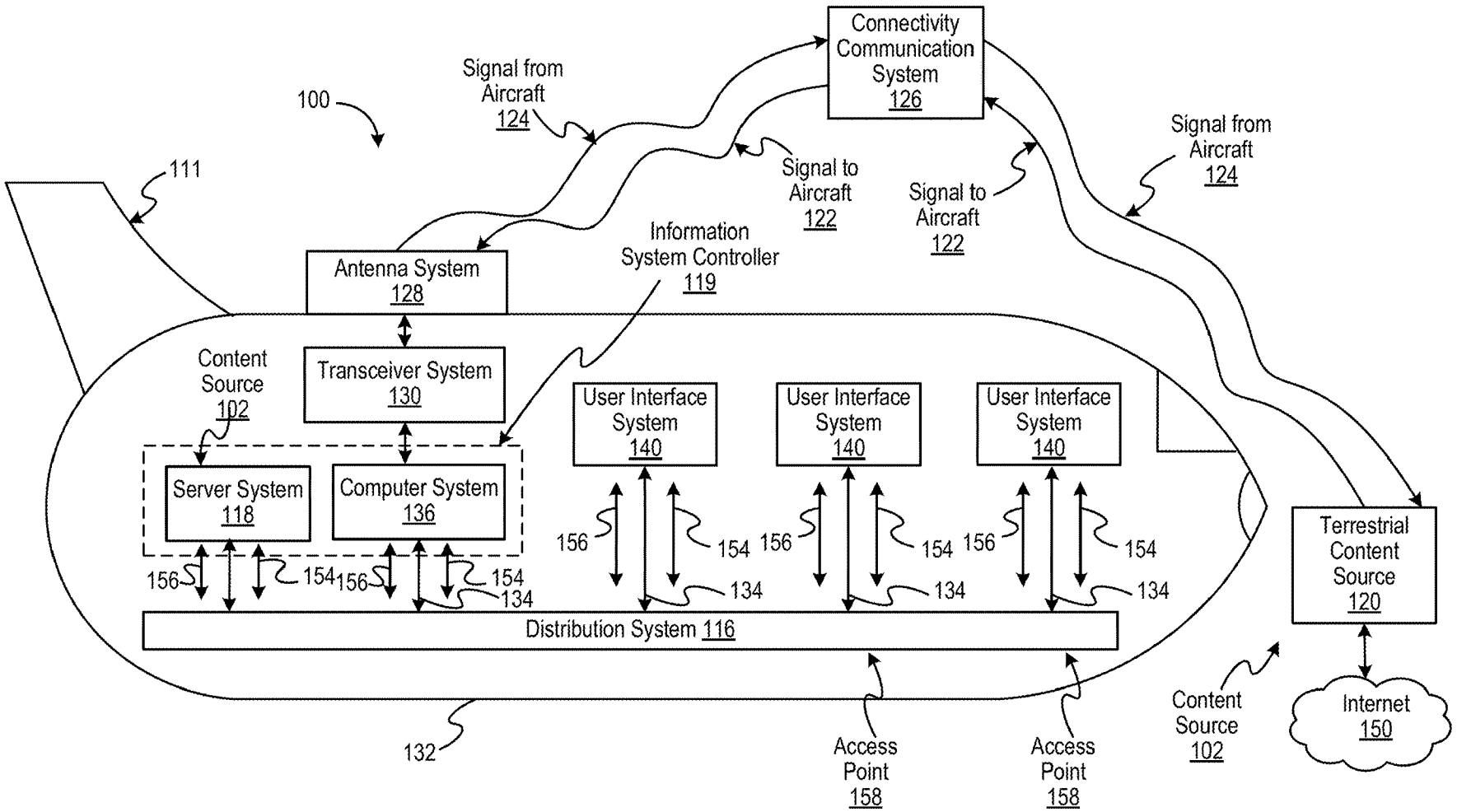
FIG. 1 is a schematic diagram of a vehicle communications system, in accordance with various aspects of the present disclosure.

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent that those skilled in the art will be able to understand the disclosure without these specific details. In some instances, well-known structures and components are shown in simplified form for brevity of description. Some of the surfaces have been left out or exaggerated for clarity and ease of explanation.

The present disclosure is directed to embodiments of antenna systems, and more particularly antenna assemblies for simultaneous communication with a plurality of satellite systems through mechanical and electrical steering of radio wave beam pointing directions. Embodiments disclosed herein may provide for multiple beams of radio waves having beam pointing directions that can be steered in azimuth and elevation to different satellite systems, such as but not limited to GEO satellites, LEO satellites, MEO satellites, HAPS etc. Example antenna assemblies described herein provide for at least a first fixed panel comprising a first phased array of antenna elements and a second panel comprising a second phased array of antenna elements. The antenna assembly is mounted on a rotatable plate that is controllably rotated about a first axis to steer the antenna assembly in azimuth to a first satellite. The first phased array of antenna elements can be controlled to steer the beam pointing direction of the emitted radio waves in elevation to the first satellite. The second panel is rotatable about a second axis that is perpendicular to the first axis to steer the second panel in elevation to a second satellite. The second phased array of antenna elements can be controlled to steer a beam pointing direction of the emitted radio waves in azimuth to the second satellite.

Accordingly, embodiments herein advantageously need only control the phased array antenna elements to electronically steer the emitted beam in single direction (e.g., in elevation or azimuth). Such operation may be referred to herein as one-dimensional scanning. This results in far less power consumption and less heat to dissipate as compared to steering a single phased array in both elevation and azimuth. For example, heat dissipation may be reduced by approximately ten-fold. Steering in the other direction is achieved through mechanical, physical rotation of the antenna assembly and second panel. Moreover, the embodiments herein can be implemented in existing footprint and power standards, such as but not limited to the ARINC 791 standard that sets forth length, width and height restrictions, at least for wide-body aircrafts. Furthermore, currently used components such as the individual antenna elements may be implemented using existing technology since the heat dissipated is reduced below critically damaging levels.

Another non-limiting advantage of the embodiments herein is that by providing simultaneous communication with multiple satellites, latency due to handovers can be reduced. Furthermore, increased frequency of handovers is achievable without excessive heat waste, thereby permitting quick and substantially seamless switching between LEO, MEO, and/or HAPS satellites and any second satellite. Thus, embodiments herein may take of the increasing presence of the LEO, MEO and other satellite platforms for providing communications.

In another example implementation, embodiments of the antenna assemblies disclosed herein may provide for improved performance (e.g., increased bandwidth, decreased latency, improved signal strength, etc.) of communications with a single satellite. For example, embodiments disclosed herein may provide for multiple beams of radio waves having beam pointing directions that can be steered in azimuth and elevation to a single satellite system. For example, the antenna assemblies may include the first fixed panel comprising the first phased array of antenna elements and the second panel comprising the second phased array of antenna elements. The antenna assembly is mounted on the rotatable plate that is controllably rotated about the first axis to steer the antenna assembly in azimuth to the satellite. The first phased array of antenna elements can be controlled to steer a beam pointing direction of the emitted radio waves in elevation to the satellite. The second panel is rotatable about the second axis that is perpendicular to the first axis to also steer the second panel in elevation to the satellite. Thus, both the first and second panel may be in communication with a common satellite, thereby providing improved performance. In some embodiments, the embodiments herein may be used to provide up to double the performance compared to conventional systems.

The terms "environment," "platform," "component," "module," "system," and the like as used herein are intended to refer to a computer-related entity, either software-executing general purpose processor, hardware, firmware or a combination thereof. For example, a component may be, but is not limited to being, a process running on a hardware processor, a hardware processor, an object, an executable, a thread of execution, a program, and/or a computer.

By way of illustration, both an application running on a server and the server can be a component. One or more components may reside within a process and/or thread of execution, and a component may be localized on one computer and/or distributed between two or more computers. Also, these components can execute from various computer readable media having various data structures stored thereon. The components may communicate via local and/or remote processes such as in accordance with a signal having one or more data packets (e.g., data from one component interacting with another component in a local system, distributed system, and/or across a network such as the Internet with other systems via the signal).

Computer executable components can be stored, for example, at non-transitory, computer/machine readable media including, but not limited to, an ASIC (application specific integrated circuit), CD (compact disc), DVD (digital video disk), ROM (read only memory), hard disk, EEPROM (electrically erasable programmable read only memory), solid state memory device or any other storage device, in accordance with the claimed subject matter.

The term "user" is used herein to refer to any person or entity that uses or otherwise interacts with the systems described here. User may refer to an operator, passenger, occupants, travelers, crew members, or any person or entity who interacts with any part of the systems described herein. The term "passengers" and/or "travelers" may refer to any persons who are customers or otherwise being transported by the vehicle who may use or otherwise interact with the systems described herein.

The term "vehicle" is illustratively used herein to refer to an aircraft, but the term is not to be so limited. It will be appreciated that the term "vehicle" may refer to any and all types of transportation vehicles including, but not limited to, personal transportation vehicles (e.g., automobiles, boats, motorcycles, etc.) and vehicles of common carriers, such as airplanes, passenger trains, buses, cruise ships, sightseeing vehicles (e.g., ships, boats, buses, cars, etc.), or any other moving vehicle.

As used herein inflight entertainment (IFE) system(s) may refer to system(s) capable of providing vehicle entertainment services without connectivity, while inflight entertainment and communication (IFEC) system(s) may refer to system(s) capable of providing vehicle entertainment services and connectivity services (e.g., services such as Internet browsing, text messaging, cell phone usage (where permitted), and emailing). However, embodiments described herein are equally applicable to both IFE and/or IFEC systems. Example IFE connectivity service providers include, but are not limited to, Zodiac Inflight Innovations, Thales Avionics, Viasat, etc., and example IFEC connectivity service provides include, but are not limited to, Gogo® Inc., Boingo Wireless, Sitaonair, Panasonic Avionics Corp., Inmarsat plc, etc.

References throughout this specification to "an embodiment" or "an implementation" mean that a particular feature, structure, or characteristic described in connection with the embodiment is included in at least one embodiment or implementation. Thus, appearances of the phrase "in an embodiment" in various places throughout this specification are not necessarily all referring to the same embodiment or a single exclusive embodiment. Furthermore, the particular features, structures, or characteristics described herein may be combined in any suitable manner in one or more embodiments or one or more implementations.

The following detailed description provides further details of the figures and example implementations of the present application. Reference numerals and descriptions of redundant elements between figures are omitted for clarity. Terms used throughout the description are provided as examples and are not intended to be limiting. For example, the use of the term "automatic" may involve fully automatic or semi-automatic implementations involving user or passenger control over certain aspects of the implementation, depending on the desired implementation of one of ordinary skill in the art practicing implementations of the present application. Further, sequential terminology, such as "first", "second", "third", etc., may be used in the description and claims simply for labeling purposes and should not be limited to referring to described actions or items occurring in the described sequence. Actions or items may be ordered into a different sequence or may be performed in parallel or dynamically, without departing from the scope of the present application. Similarly, the various processes and methods described herein may be described with reference to flow charts having process blocks illustrated in a particular sequence. However, the example implementations are not limited to the particular sequence illustrated. Example implementations may include actions being ordered into a different sequence as may be apparent to a person of ordinary skill in the art or actions may be performed in parallel or dynamically, without departing from the scope of the present application.

FIG. 1 is a schematic diagram of a vehicle communications system, in accordance with various aspects of the present disclosure. The vehicle communication system 100 (referred to herein as system 100) can be installed aboard a vehicle 111.

The system 100 may be configured to provide an internal network system within the vehicle 111 that facilitates communication with user interface systems 140 carried by the vehicle. The system 100 may be used to provide a broad range of communications and entertainment services to user interface systems onboard a vehicle 111, including internet broadcasts, full interactive internet, live television, internet television service, high speed internet service, simultaneous internet and television, IPTV (internet protocol television) IP television streaming, and voice service, among other communications services. When installed on an aircraft, system 100 may be or otherwise be comprised as part of an aircraft IFE and/or IFEC system.

System 100 comprises a content source 102 and one or more user interface systems 140 communicatively coupled with a real-time content distribution system 116. User interface systems 140 may comprise in-seat devices, seatback devices, personal electronic devices (PED), or any combination thereof through which occupants or users (e.g., passengers, crew members, or other persons carried by the vehicle 111) may interact with the system 100. Example PEDs may include any device having wireless communication capability, such as cellular phones, smart phones, tablet computers, laptop computers, and other portable electronic devices, a digital electronic media device, wearable smart electronic device, smart watch, any mobile electronic device, and the like. User interface systems 140 may also be a device integrated with the vehicle and connected to an internal network system of the vehicle (e.g., interactive screen on the back of the headrest on an airplane), such as in-seat and/or seatback devices including a monitor display.

The content sources 102 may include one or more internal content sources, included in a server system 118 installed aboard the vehicle 111, one or more remote (or terrestrial) content sources 120 external from the vehicle 111, or a distributed content system (e.g., a distributed cloud system). The server system 118 can be provided as or as part of an information system controller 119 (sometimes referred to as an onboard management system) for providing overall system control functions for system 100 and/or for storing multimedia content, including pre-programmed content and/or content downloaded to the vehicle 111, as desired.

The information system controller 119 may include one or more servers and databases which host and/or execute one or more of the various functions, processes, and/or methods described herein. Example services (sometimes referred to herein as IFE and/or IFEC services or functionality or vehicle entertainment services or functionality) offered by system 100 includes, but is not limited to, in-flight Intranet and Internet, information, entertainment (e.g., multimedia entertainment services such as video, movies, television programming, audio, games, etc.), communications (e.g., telephone, VoIP, messaging, etc.), access to retail or shopping catalogs, crew assistance requests, payment services, and/or other system services during travel aboard vehicle 111. In some embodiments, remote content source 120 may also comprise dedicated servers and databases, or may instead be part of a cloud infrastructure, which utilize shared resources of one or more servers for executing and/or supporting the vehicle entertainment functionality.

In some embodiments, the information system controller 119 may also comprise or be communicatively connected to a backend application and/or one or more databases. For example, server system 118 may include one or more servers that host one or more backend application platforms for interfacing with user interface systems 140 for executing functions. The server system 118 transmits or serves these user interface systems 140 in response to requests from user interface systems 140 over the content distribution system 116. These executed functions may comprise a combination of content and elements, such as text, images, videos, animations, references (e.g., hyperlinks), frames, inputs (e.g., textboxes, text areas, checkboxes, radio buttons, drop-down menus, buttons, forms, etc.), scripts (e.g., JavaScript), and the like, including elements comprising or derived from data stored in one or more databases that are locally accessible to media server system 118 or remotely accessible from remote content source 120.

Multimedia content available from the content sources 102 and/or remote content source 120 may provide for two-way communications (e.g., bidirectional communications), such as real-time access to the Internet 150 and/or telecommunications systems (e.g., cellular telecommunication systems). Other content available from the content sources 102 may include television programming content, music content, podcast content, photograph album content, audiobook content, and/or movie content without limitation. Content as shown and described herein is not exhaustive and is provided herein for purposes of illustration only and not for purposes of limitation. Multimedia content can comprise any conventional type of audio and/or video content, such as stored (or time-delayed) content and/or live (or real-time) content. The multimedia content can include geographical information.

Being configured to distribute and/or present the content provided by content sources 102 and/or remote content source 120, system 100 can communicate with the content source 102 and/or remote content source 120 in real time and in any conventional manner, including via wired and/or wireless communications. System 100 and the remote content source 120, for example, can communicate directly and/or indirectly via an intermediate communication system, such as a connectivity communication system 126. Connectivity communication system 126 may provide wireless bidirectional communications, for example, data signals comprising content for system 100. In some embodiments, the bidirectional communication may be a bidirectional communication link over the Internet or other wireless communication protocol. System 100 thereby can receive content from remote content source 120 via data signal 122 and/or transmit (upload) content via data signal 124 (which may be referred to collectively as a bidirectional communication link), including navigation and other control instructions, to the remote content source 120. The remote content source 120 is shown as providing access to the Internet 150 using standard transmission protocols, such as HyperText Transfer Protocol (HTTP), Secure HTTP (HTTPS), File Transfer Protocol (FTP), FTP Secure (FTPS), SSH FTP (SFTP), and the like, as well as proprietary protocols. The connectivity communication system 126 may comprise a satellite communication system (e.g., as described below) or any conventional type of wireless communication system, such as a cellular communication system (not shown) and/or an Aircraft Ground Information System (AGIS) communication system (not shown).

To facilitate communications with the remote content source 120, system 100 may also include an antenna system 128 and a transceiver system 130 for bidirectional communication of data (e.g., content, control, information, etc.) with the remote content source 120. The antenna system 128 may be disposed outside of the aircraft, such as an exterior surface of a fuselage 132 of the vehicle 111. The antenna system 128 can receive content from the remote content source 120 and provide the data, as processed by the transceiver system 130, to a computer system 136 of the information system controller 119, as described in greater detail below in connection to FIGS. 4 and 5.

In operation, content may be beamed from and/or from the remote content source 120 via a bidirectional communication link provided by connectivity communication system 126 to and/or from the antenna system 128. In some embodiments, the bidirectional communication link may comprise a 3:1 ratio of bandwidth allocated to the forward link (e.g., to the antenna system 128 from the remote content source 120) compared to the return link (e.g., from the antenna system 128 to the remote content source 120). For example, when content is beamed from the remote content source 120 to the antenna system 128, upon receiving the data signals 122, the antenna system 128 can provide the received content to the transceiver system 130. As desired, the antenna system 128 can preprocess the received content in any conventional manner and provide the preprocessed content to the transceiver system 130. Illustrative preprocessing operations can include amplification and/or down-conversion of the received content without limitation. In an embodiment the received content may be received as a pair of high-frequency signals within the $K_u$-Band (10.7 GHz-12.75 GHz) and are down-converted into a pair of intermediate-frequency (or low-frequency) signals within a predetermined intermediate-frequency (or low-frequency) band, such as the L-Band (950 MHz-2150 MHz). In some implementations, a $K_u$-Band at 14.04 GHz-14.5 GHz may be used for receiving the pair of signals. In some embodiments, the content may be received as a pair of high-frequency signals within the $K_a$-Band (26.5 GHz-40 GHz) and are down-converted into a pair of intermediate-frequency (or low-frequency) signals. In various implementations, reference to the $K_a$-Band (sometimes also referred to as a K-$K_a$ Band) refers to utilizing the $K_a$-Band for the return link and the K-Band for the forward link. In another example, the content may be exchanged using a 5G link over a satellite. Similarly, when content is beamed from the antenna system 128 to the remote content source 120, the transceiver system 130 can include up-conversion of the content to be uploaded to the connectivity communication system 126, for example, by up-converting a pair of intermediate-frequency (or low-frequency) signals to a the $K_u$-Band or $K_a$-Band for transmission by the antenna system 128. While only one transceiver system 130 is shown, a plurality of transceiver systems may be included to enable simultaneous reception of signals from a plurality of transponders. The components of the subsystems included in the transceiver system 130 may be partially or fully integrated and/or separately implemented. In some embodiments, transceiver system 130 may be comprised as part of or include a modem or other hardware, for example, and utilize a satellite interface protocol such as, but not limited to, DVB-S2, 5G non-terrestrial network protocol, and the like.

In some embodiments, a "pair" of signals as used herein may refer to a duplex pairing, for example, one signal on the forward link and one on the return link. In various embodiments, a "pair" of signals may refer to operation of the two simultaneous bidirectional communication links, and thus for example comprise a pair or two signals on the forward link and a pair of two signals on the return link. In some embodiments, alone or in combination, low-frequency may refer to a true baseband meaning exchanging I- and Q components as separate waveforms and thus the pair of signals may comprise up to 8 signal paths, e.g., four in each direction. Furthermore, in some embodiments, the antenna system may have the capacity to receive the two different polarizations (e.g., linear polarizations in the case of $K_u$-Band and/or chirality in the case of K-$K_a$ Band) and output them separately as a "pair" of signals.

It will be appreciated that, the antenna system 128 may not receive a "signal" nor emit one, per se. Instead, the antenna system 128, in some embodiments, may be converting a block of frequency spectrum that happens to be 500 MHz wide. In the transmit direction, a waveform, which may occupy 10 MHz, from the transceiver system 130 (e.g., a modem included therein) may be emitted, and in the receive direction, all that is within that 500 MHz block will be sent to the modem.

The antenna system 128 can convert the received data signals into the preprocessed content 134 that is suitable for distribution throughout the system 100 without significant cable loss and/or signal degradation. The transceiver system 130 can receive the content as data signals 122, including the received content and/or the preprocessed content, from the antenna system 128 and can demodulate the content. Upon demodulating the content, the transceiver system 130 can provide the demodulated content 134 to the content distribution system 116 for distribution throughout the system 100. The demodulated content 134 thereby can be presented via the user interface systems 140 of the system 100.

Content in the form of data signals received by the antenna system 128 may be communicated to the computer system 136 and passed to the media server system 118 and/or directly to one or more of the user interface systems 140 as content 134, user instructions 154, and/or control signals 156, as desired. Although shown and described as being separate systems for purposes of illustration, the computer system 136 and the media server system 118 can be at least partially and/or fully integrated.

User interface systems 140 may be computing terminals communicatively coupled to the content distribution system 116 via one or more corresponding access points 158. User interface systems 140 may include a display device configured to display or otherwise present content 134 to a user, for example, a graphical user interface for generating screens, pages, or webpages. The user interface systems 140 includes a hardware interface to connect to an access point 158 that provides a wired and/or a wireless connection for the user interface systems 140. The user interface systems 140 may be utilized by the user to enter or input user instructions to select desired content 134 and control the manner in which the selected content 134 is received and/or presented. While bandwidth limitation issues may occur in a wired system on a vehicle, such as a vehicle 111, in general the wired portion of the system 100 is designed with sufficient bandwidth to support all users aboard the vehicle, e.g., occupants.

Figure 2:
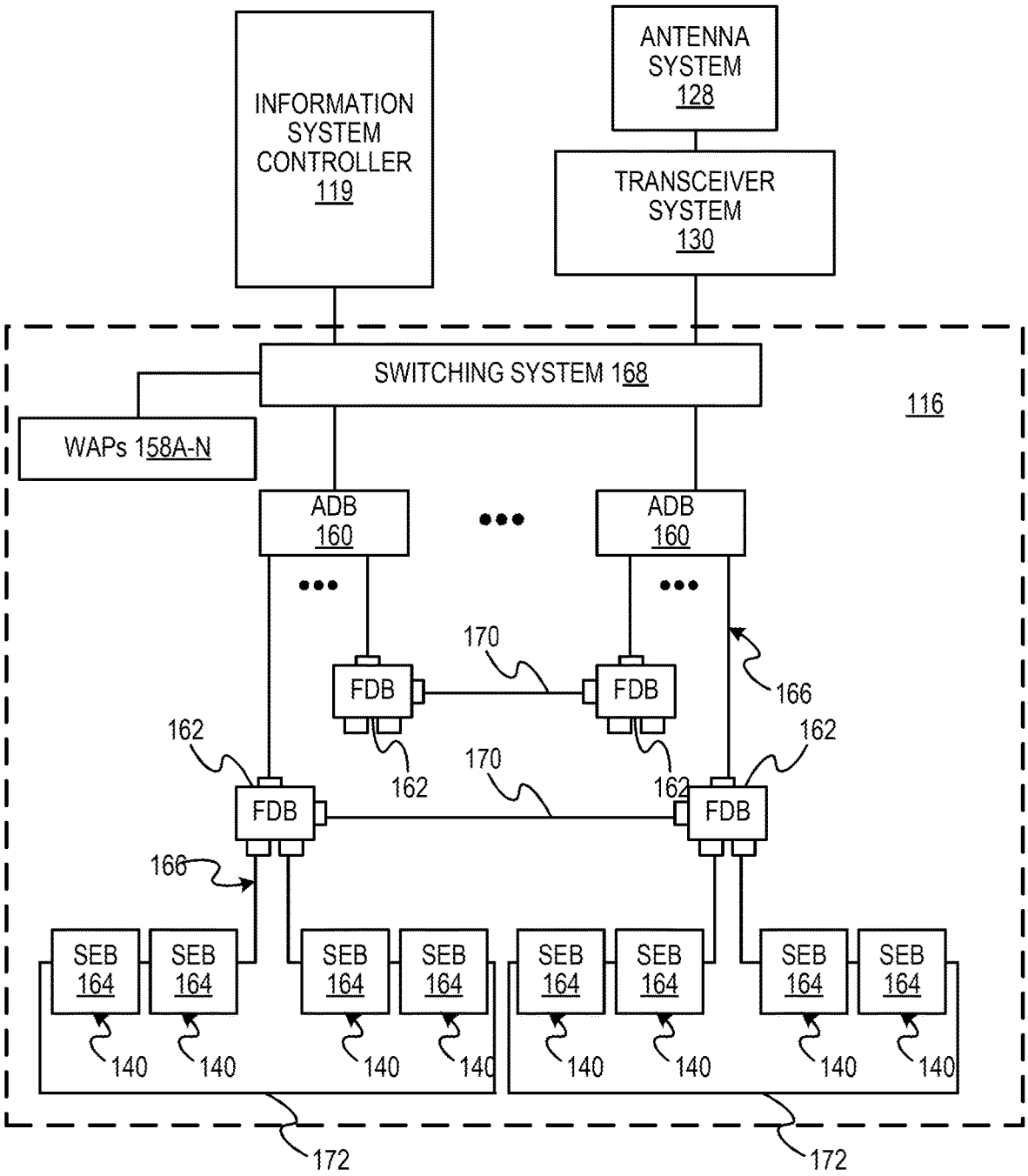
FIG. 2 is a schematic block diagram illustrating an example content distribution system, in accordance with various aspects of the present disclosure.

FIG. 2 is a schematic block diagram illustrating an example content distribution system, in accordance with various aspects of the present disclosure. FIG. 2 illustrates an example of the content distribution system 116 for the system 100. The content distribution system 116 couples and supports communication between the information system controller 119, and the plurality of user interface systems 140.

The content distribution system 116, for example, can be provided as a conventional wired and/or wireless communication network, including a telephone network, a local area network (LAN), a wide area network (WAN), a campus area network (CAN), personal area network (PAN) and/or a wireless local area network (WLAN) of any kind. Exemplary wireless local area networks include wireless fidelity (Wi-Fi) networks in accordance with Institute of Electrical and Electronics Engineers (IEEE) Standard 522.11 and/or wireless metropolitan-area networks (MANs), which also are known as WiMax Wireless Broadband, in accordance with IEEE Standard 522.16. Preferably being configured to support high data transfer rates, the content distribution system 116 may comprise a high-speed Ethernet network, such as any type of Fast Ethernet (such as 100 Base-X and/or 100 Base-T) communication network and/or Gigabit (such as 1000 Base-X and/or 1000 Base-T) Ethernet communication network, with a typical data transfer rate of at least approximately one hundred megabits per second (100 Mbps) or any other transfer rate. To achieve high data transfer rates in a wireless communications environment, free-space optics (or laser) technology, millimeter wave (or microwave) technology, and/or Ultra-Wideband (UWB) technology can be utilized to support communications among the various system resources, as desired.

As illustrated in FIG. 2, the content distribution system 116 can be provided as a plurality of area distribution boxes (ADBs) 160, a plurality of floor disconnect boxes (FDBs) 162, and a plurality of seat electronics boxes (SEBs) (and/or video seat electronics boxes (VSEBs) and/or premium seat electronics boxes (PSEBs)) 164 being configured to communicate in real time via a plurality of wired and/or wireless communication connections 166. The content distribution system 116 likewise can include a switching system 168 for providing an interface between the content distribution system 116 and the information system controller 119. The switching system 168 can comprise a conventional switching system, such as an Ethernet switching system, and is configured to couple the information system controller 119 with the area distribution boxes 160. Each of the area distribution boxes 160 is coupled with, and communicates with, the switching system 168. In addition, the content distribution system 116 includes one or more wireless access points (WAPs) (158A to 158N) connected in communication with the switch system 168 for wireless distribution of content to user interface systems 140 such as, for example, PEDs.

Each of the area distribution boxes 160, in turn, may be coupled to, and communicate with, at least one floor disconnect box 162. Although the area distribution boxes 160 and the associated floor disconnect boxes 162 can be coupled in any conventional configuration, for example, the associated floor disconnect boxes 162 are disposed in a star network topology about a central area distribution box 160 as illustrated in FIG. 2. Each floor disconnect box 162 is coupled with, and services, a plurality of daisy-chains of seat electronics boxes 164. The seat electronics boxes 164, in turn, are configured to communicate with the user interface systems 140. Each seat electronics box 164 can support one or more of the user interface systems 140.

The switching systems 168, the area distribution boxes 160, the floor disconnect boxes 162, the seat electronics boxes (and/or video seat electronics boxes (VSEBs) and/or premium seat electronics boxes (PSEBs)) 164, the antenna system 128, the transceiver system 130, the content source 102, the information system controller 119, and other system resources of the system 100 are provided as line replaceable units (LRUs). The use of LRUs may facilitate maintenance of the system 100 because a defective LRU can simply be removed from the system 100 and replaced with a new (or different) LRU. The defective LRU thereafter can be repaired for subsequent installation. Advantageously, the use of LRUs can promote flexibility in configuring the content distribution system 116 by permitting ready modification of the number, arrangement, and/or configuration of the system resources of the content distribution system 116. The content distribution system 116 likewise can be readily upgraded by replacing any obsolete LRUs with new LRUs.

The content distribution system 116 can include at least one FDB internal port bypass connection 170 and/or at least one SEB loopback connection 172. Each FDB internal port bypass connection 170 is a communication connection 166 that permits floor disconnect boxes 162 associated with different area distribution boxes 160 to directly communicate. Each SEB loopback connection 172 is a communication connection 166 that directly couples the last seat electronics box 164 in each daisy-chain of seat electronics boxes 164 for a selected floor disconnect box 162 as shown in FIG. 2. Each SEB loopback connection 172 therefore forms a loopback path among the daisy-chained seat electronics boxes 164 coupled with the relevant floor disconnect box 162.

The various aspects of the present disclosure may be implemented without using FDB 162. When FDB 162 is not used, ADB 160 communicates directly with SEB 164 and/or information system controller 119 may communicate directly with SEB 164 or the seats. The various aspects of the present disclosure are not limited to any specific network configuration.

Figure 3:
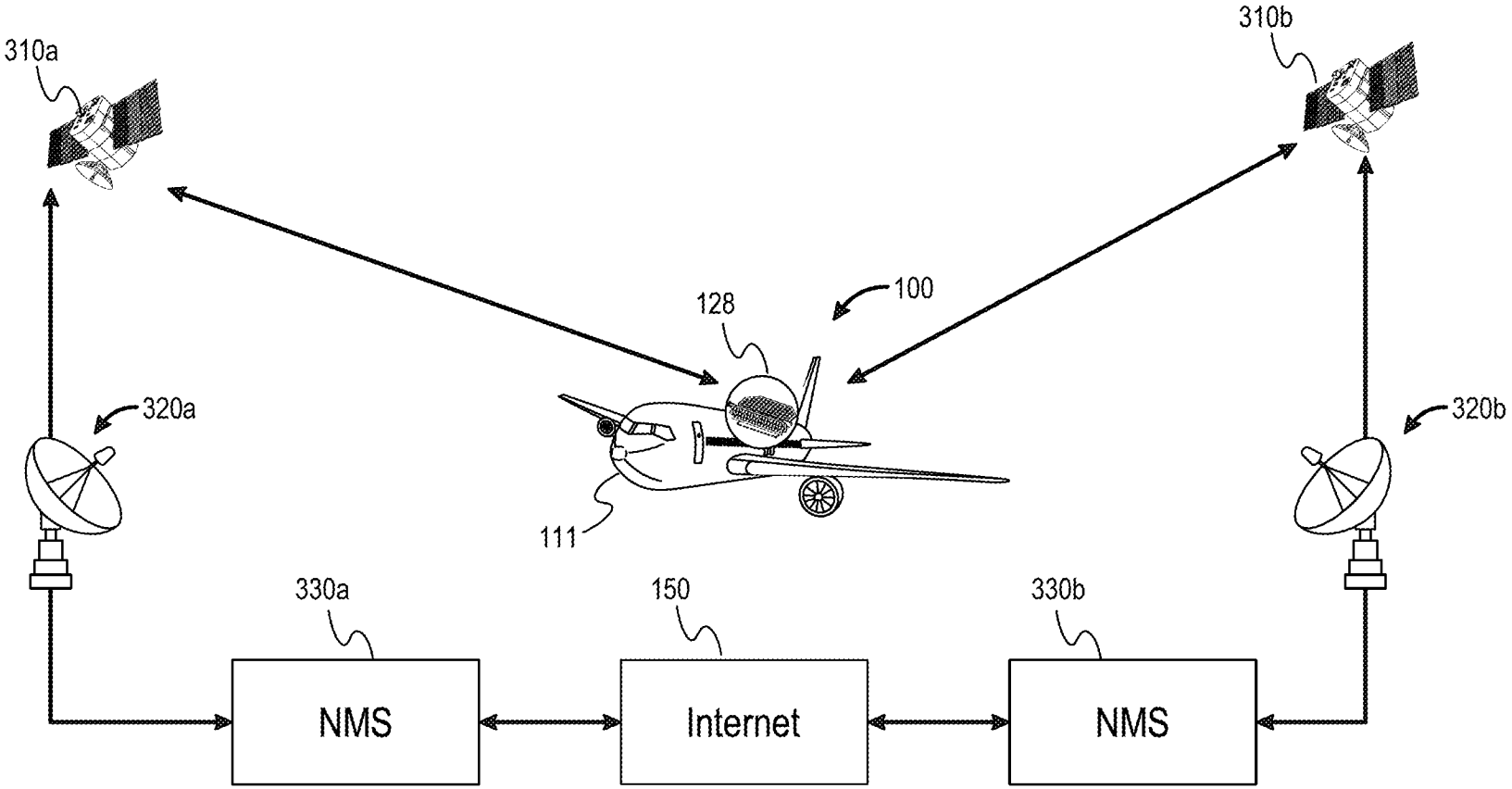
FIG. 3 is another schematic diagram illustrating the vehicle communications system of FIG. 1, in accordance with various aspects of the present disclosure.

FIG. 3 is another schematic diagram illustrating the vehicle communications system of FIG. 1, in accordance with various aspects of the present disclosure. The system 100 includes a ground-based connectivity system for providing bidirectional communication services to a vehicle 111 via an intermediate communication system, such as one or more connectivity communication system 126 of FIG. 1. For example, as illustrated in FIG. 3, the connectivity communication system 126 may be implemented as satellite system(s), such as but not limited to satellite systems 310*a* and 310*b* (collectively referred to herein as satellites 310). Each satellite system 310 may be in communication with a ground-based transceiver hub 320 and a network management system (NMS) 330. Transceiver hubs 320 may be base stations providing communication access to a respective NMS 330 for a geographic coverage area corresponding to the transceiver hub 320. Example transceiver hubs include, but are not limited to, 5G non-terrestrial network gNB stations, 4G-LTE eNB, 3G NodeB, or the like. The NMS 330 may include or be communicatively coupled to a network operations center (NOC) and a host system (e.g., an internet or network service provider system). Each satellite system 310 may be configured for receiving a request from the antenna system 128 and communicating the request to its respective NMS 330 via communicative coupling with a respective ground-based transceiver hub 320. While FIG. 3 illustratively shows two satellites, any number of satellites orbiting the earth may be included in the system.

The satellite systems 310 may be one or more of a LEO satellite system orbiting the earth (or a particular celestial body) at approximately 1,000 km above the surface of the earth, MEO satellite system orbiting the earth, GEO satellite system that remains in approximately the same position relative to a particular location on the earth (or a particular celestial body) at approximately 36,000 km above the surface of the earth, HAPS systems orbiting the earth (or a particular celestial body) at approximately 20 km above the surface of the earth, etc.

As currently practical, GEO satellites are a practical infrastructure in terms of providing global-wide satellite service with reasonable costs, because global-wide satellite coverage may be achieved with as few as three GEO satellites. However, GEO satellite systems perform with higher than desired latency of about 240-260 milliseconds, thereby impacting performance. As used herein GEO satellites may refer to any type of geosynchronous satellite, for example, but not limited to, geostationary orbit satellites with circular orbits, elliptical geosynchronous orbit, inclined geosynchronous orbit, etc.

LEO satellites and HAPS are becoming increasing relevant, and 5G non-terrestrial (NTN) networks that provide communication transparency between GEO, LEO and HAPS are providing seamless interconnection between various satellite types. As a result, increased cost effective and optimized services can be provided by flexible use of multi-orbit satellites. For example, LEO satellites have a latency of about 6 milliseconds and HAPS have a latency of about 1 millisecond. However, LEO satellites are capable of communications with antenna systems within a smaller coverage region than GEO satellites and accordingly require approximately 1,000 satellites or more to provide global-wide satellite services with reasonable costs. Similarly, HAPS are capable of even smaller converge regions than LEO satellites, thereby requiring approximately 5,000 satellites to provide global-wide satellite services with reasonable costs. Furthermore, both LEO and HAPS are consistently changing position relative to the earth as they orbit, thereby necessitating an increase in handover frequency. Further still, GEO LEO, HAPS, and MEO satellite systems may utilize the $K_u$-band and/or $K_a$-band.

Accordingly, the embodiments described herein are configured for communication with multiple satellite systems of different types simultaneously and are capable of multi-band communication. Thus, satellite system 310 may be one or more of a LEO satellite system, MEO satellite system, GEO satellite system, HAPS system, etc., or any combination thereof.

For example, one or more of satellite systems 310 may include a LEO satellite system, and the antenna system 128 may be configured for transmitting and receiving data from LEO satellite system 310*a* using the respective frequency band for such communications. The LEO satellite system 310*a* may be in communication with NMS 330*a* via the ground-based transceiver hub 320*a*. The LEO satellite system 310 may be part of a system of LEO satellites comprising a plurality of satellites for providing two-way communication with the antenna system 128, for example, satellite system 310*a* and/or 310*b* may both be LEO satellites. The LEO satellite system may operate in the $K_a$-Band and/or the $K_u$-Band of the electromagnetic spectrum.

In some embodiments, one or more of the satellite systems 310 may include a GEO satellite in communication with the NMW 330. A single GEO satellite may be part of a system of GEO satellites for providing two-way communication with the antenna system 128, for example, satellite systems 310*a* and 310*b* may both be GEO satellite systems. In some embodiments, the GEO satellite includes a satellite that is configured to transmit in the $K_a$ band and/or in the $K_u$ band of the electromagnetic spectrum.

In some embodiments, one or more of the satellite systems 310 may be a HAPS that is in communication with the NMW 330. The HAPS may be part of a system of HAPS for providing two-way communication with the antenna system 128, for example, satellite systems 310 may both be implemented as HAPS. Accordingly, HAPS may be referred to herein as a satellite system; however, it will be appreciated that HAPS refers to atmospheric satellites or pseudo-satellite systems. Example HAPS systems may include an aircraft (e.g., a unmanned aerial vehicle) that operates in the atmosphere for extended periods of time, in order to provide services conventionally provided by an artificial satellite orbiting in space. HAPS systems utilize atmospheric lift, whereas conventional satellites in orbit operate in the vacuum of space and remain in flight through centrifugal force derived from their orbital speed. In some embodiments, the HAPS includes a communication interface that is configured to communicate with the antenna system using the $K_a$ band and/or in the $K_u$ band of the electromagnetic spectrum (e.g., as a feeder band) and provide access to the International Mobile Telecommunications (IMT) band.

Each satellite of the system may be the same type or a different type of satellite from other satellites. That is, for example, satellite systems 310*a* and 310*b* may both be LEO satellites, GEO satellites, HAPS, etc. Alternatively, satellite system 310*a* may be a first type (e.g., one of LEO, GEO, HAPS, etc.) while the satellite system 310*b* is second type (e.g., one of HAPS, GEO, LEO that is not the same as the first type).

In some embodiments, the antenna system 128 is configured to receive one or more bands of frequencies from one or more satellite systems 310*a* and 310*b* simultaneously, including but not limited to GEO satellites, LEO satellites, HAPS, etc. For example, in some embodiments, the antenna system 128 includes a multi-band antenna configured to receive signals in the $K_a$ band of the electromagnetic spectrum, the $K_u$ band of the electromagnetic spectrum, etc. For example, in some embodiments the antenna system 128 comprises a dual-band antenna configuration arranged to receive signals simultaneously, approximately simultaneously, or non-concurrently from a plurality of satellites over the $K_a$- and $K_u$-bands. Furthermore, in various embodiments, the plurality of satellites may be the same or different types of satellites (e.g., one or more of GEO, LEO, HAPS).

In various embodiments, the satellite system 310*a* and the satellite system 310*b* may be in communication with NMS 330. The NMS may be capable of providing direct broadcast satellite communication and data services. The NMS may be configured to communicate with the internet 150, including the World Wide Web as well as other services such as data services, direct broadcast television program, telephone, facsimile, email, weather, ADS-B (Automatic Dependent Surveillance Broadcast) data, ADS-B satcom data, and other services, and the like. In some embodiments, the system 100 is configured to simultaneously, nearly simultaneously, or non-concurrently provide one or more of the data services. In some embodiments, the NMS may comprise a core network, such as a 3G, 4G LTE, 5G, etc. core network providing cellular network access to the internet 150.

Embodiments of the invention include at least two satellites being in communication with at least one NMS. The NMS is configured for receiving and transmitting communications with their corresponding satellite network as well as an indicated recipient or ISP. The NMS is configured to direct communication with internet or other service providers. For example, a particular satellite system 310*a* transmits communications exchanged with the antenna system 128 to a first NMS 330*a* via first transceiver hub 320*a*. The first NMS 330*a* may be operated by a ground based service provider associated with the satellite system 310*a*. Additionally, satellite system 310*b* may be in communication with a second NMS 330*b*. The second NMS 330*b* may be operated by a ground based service provider associated with the satellite system 310*b*. NMS 330*a* and 330*b* may be operated by the same or different ground base service providers. Similarly, NMS 330*a* and NMS 330*b* may represent the same NMS for a ground-based service provider associated with both satellite systems 310*a*, 310*b*.

Each satellite system 310*a*, 310*b* is capable of communications within a three-dimensional physical coverage region that is based, in part, on the type of satellite implemented (e.g., GEO offer larger coverage areas and HAPS offer the smallest). Thus, each satellite system 310*a*, 310*b* provides communication services (e.g., data signals 122 of FIG. 1) within a predetermined coverage region and/or is capable of receiving data signals (e.g., data signals 123 of FIG. 1). When the vehicle 111 is within a coverage region of a given satellite system 310*a*, the antenna system 128 communicatively couples to the satellite system 310*a* and the system 100 can exchange data signals with the NMS 330*a* via the transceiver hub 320*a*. The vehicle 111 can enter and exit the coverage regions of multiple satellites as the satellite systems move relative to the vehicle 111; as the vehicle 111 moves relative to the satellite systems; and/or as the vehicle 111 and satellite systems move. For example, at a first instance the vehicle 111 may be within the coverage region of satellite system 310*a*. The vehicle 111 may subsequently exit the coverage region of satellite system 310*a* and enter the coverage region of satellite system 310*b* as, for example, the satellite system 310*a* moves relative to the vehicle 111. As the vehicle 111 exits the coverage region of satellite system 310*a*, the antenna system 128 advantageously can be configured (e.g., steered, directed, pointed, aimed, etc.) to simultaneously communicate with both satellites system 310*a* and 310*b* to ensure an automatic switch (e.g., handover) from communication with the satellite system 310*a* to communication with satellite system 310*b* with minimal or limited interruption in service. The simultaneous communication with both satellite systems 310*a* and 310*b* may be referred to as a "soft" handover that ensures communications are established with a second satellite system before ceasing communications with a first satellite system. The soft handover advantageously minimizes and may even eliminate interruption in communications that are otherwise experienced during a "hard" handover, which can take 8 seconds or more to complete.

Figure 4:
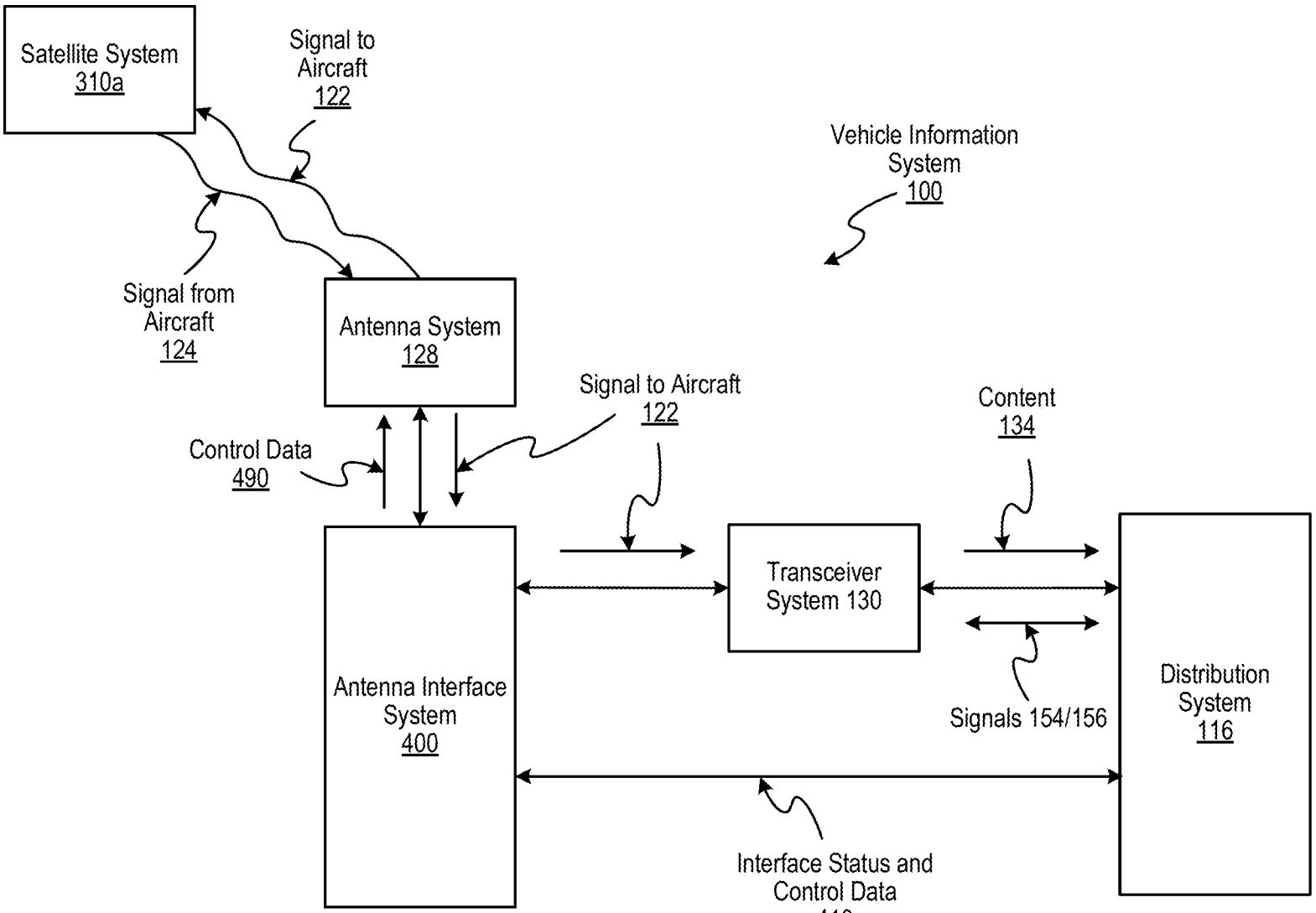
FIG. 4 is an exemplary top-level block diagram of the vehicle information system of FIG. 1, in accordance with various aspects of the present disclosure.

FIG. 4 is an exemplary top-level block diagram of the vehicle information system of FIG. 1, in accordance with various aspects of the present disclosure.

As described above, the vehicle information system 100 includes the antenna system 128 and the transceiver system 130. The antenna system 128 is configured to exchange data signals 124 and 122 in the manner set forth above and communicates with the transceiver system 130 via an antenna interface system 400. The antenna interface system 400 may be included as part of the information system controller 119, as part of the antenna system 128, and/or as intermediate system there between. Operating under the control of the server system 118 (shown in FIG. 1), the antenna interface system 400 can exchange interface status and control data 218 with the distribution system 116 via the information system controller 119. The information system controller 119 thereby can provide instruction for controlling the operation of the antenna system 128 via interface status and control data 418, and the antenna interface system 400, upon receiving the interface status and control data 418, can execute the instruction to control the antenna system 128 in accordance with the instruction provided by the information system controller 119.

For example, as the vehicle 111 enters a coverage region (as described above in connection to FIG. 3) of a relevant satellite system 310 (e.g., one of satellite systems 310*a*, 310*b*, etc.), the information system controller 119 can provide interface status and control data 418 for configuring the antenna system 128 to communicate with the appropriate satellite system 310. Upon receiving the interface status and control data 418, the antenna interface system 400 can configure the antenna system 128. The antenna system 128 can automatically exchange data signals 122 and 124 with the satellite system as the vehicle enters the associated coverage region. As desired, the antenna system 128 can maintain communication with the satellite system, and continue to communicate while the vehicle 111 remains within the associated coverage region.

Antenna control data 490 likewise can include steering data for aiming the antenna system 128 to a desired position, for example, by controlling a physical position of the antenna system 128 and/or steering a direction of radio frequency (RF) wave propagation. The antenna interface system 400 thereby can continuously aim the antenna system 128 toward the satellite system 310 as the satellite system 310 moves relative to the vehicle 111 such that the vehicle 111 passes through the associated coverage region. Further, the configuration of the antenna system 128 can be updated, as desired, during travel, for example, through the use of an open-looped control system. The antenna interface system 400, for instance, can configure the antenna system 128 for communicating with another satellite system 310 as it subsequently approaches the vehicle 111 such that the vehicle 111 enters a coverage region of another satellite system 310. The antenna system 128 thereby can continuously receive communications during travel. As desired, antenna power, phase and/or amplitude can be provided to the antenna system 128 as part of the control data 490 through the antenna interface system 400. Such information may be used to detect that the vehicle is approaching an edge of a coverage region and is about to exit a coverage region and/or that a different satellite system is offering a stronger signal for communications.

Upon receiving the data signals 122, the antenna interface system 400 can provide the received signals to the transceiver system 130. As desired, the antenna interface system 400 can preprocess the received signals as described above and provide the processed signals to the transceiver system 130.

Figure 5:
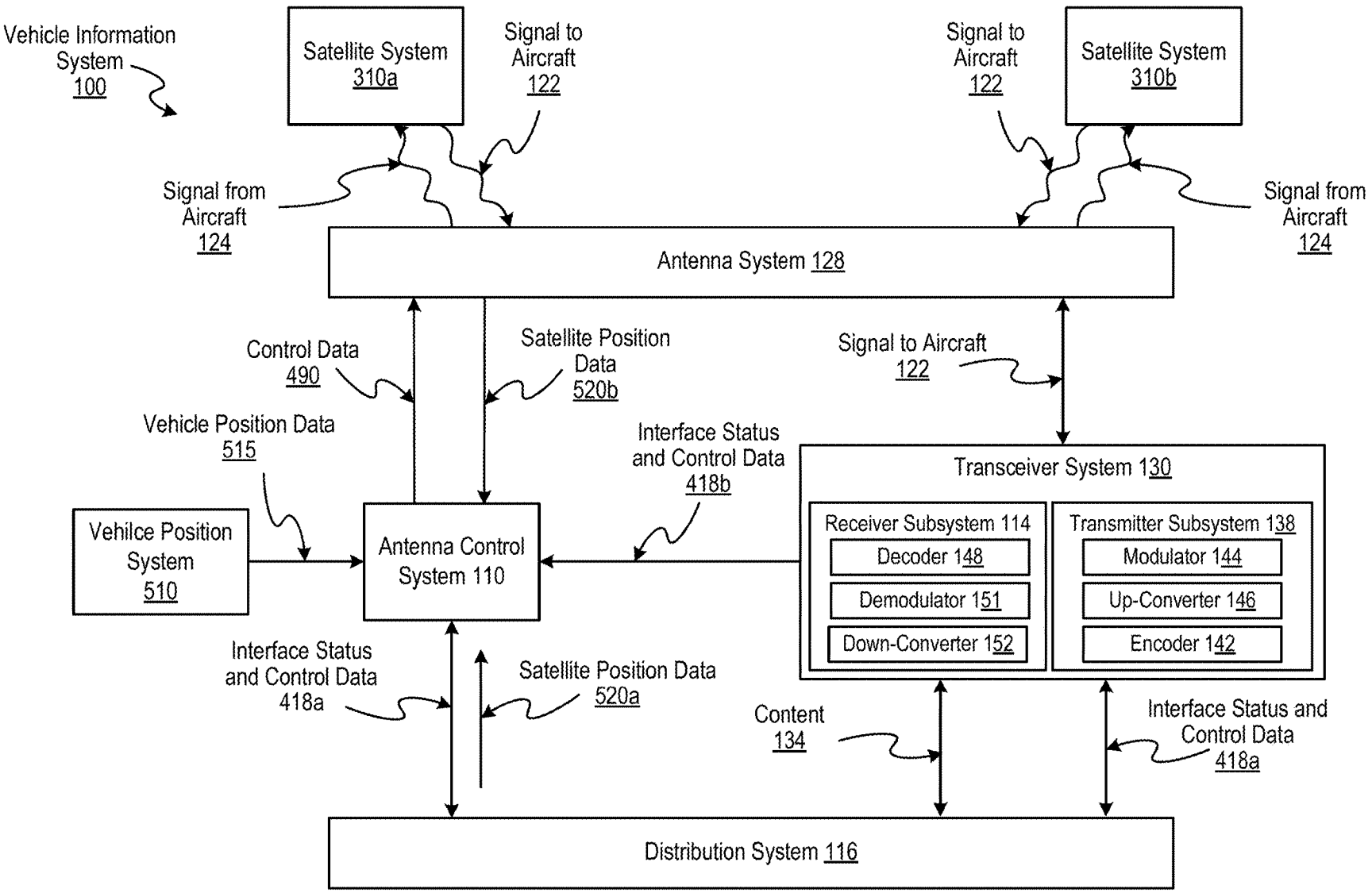
FIG. 5 is a block diagram illustrating an example embodiment of the vehicle information system of FIG. 1, in accordance with various aspects of the present disclosure.

FIG. 5 is a block diagram illustrating an example embodiment of the vehicle information system of FIG. 1, in accordance with various aspects of the present disclosure. FIG. 5 illustrates the system 100 including an antenna control system 500 for directing the antenna system 128 toward a satellite system 310 and the transceiver system 130 for converting the received signals 122 into a form suitable for distribution throughout the system 100. The antenna control system 500 may be integrated as part of the information system controller 119, included as part of the antenna system, and/or be included as a standalone system in system 100. FIG. 5 also illustrates a transceiver system comprising a receiver subsystem 114 for down-conversion of received signals and a transmitting subsystem 138 for up-conversion of transmitted signals. FIG. 5 depicts the antenna control system 500 for directing the antenna system 128 toward the satellite system 310 based upon a comparison of vehicle position data and satellite position data and based upon a feedback control signal provided by the transceiver system 130.

In the manner discussed in more detail above with reference to FIG. 4 above, the vehicle information system 100 of FIG. 5 is shown configured to receive and selectably present the content 134 via the satellite system 310 as described herein. As the vehicle 111 enters a coverage region of the satellite system 310, the antenna control system 500 configures the antenna system 128 for exchanging data signals 124 and 122. For example, the antenna control system 500 can receive control data 490 for directing the antenna system 128 toward the satellite system 310 as set forth above. The antenna system 128 thereby can communicate with the satellite system 310 upon entering, and during passage through, the coverage region of the satellite system 310.

The antenna control system 500 includes the antenna interface system 400 for initiating and/or maintaining communication between the antenna system 128 and the satellite system 310. The antenna control system 500 may comprise any conventional type of antenna controller and can direct the antenna system 128 toward the satellite system 310 in any suitable manner. Operating under the control of the server system 118 (shown in FIG. 1), the antenna control system 500 shown in FIG. 5 can exchange antenna status and control data 418*a* with the information system controller 119 via the content distribution system 116.

The antenna status and control data 418 may include, for example, positional instruction for directing the antenna system 128 and/or communication instructions for establishing one or more signal characteristics, such as a frequency band and/or a signal polarity, of signals to be exchanged with the satellite system 310. Upon receiving the antenna status and control data 418, the antenna interface system 400 can configure the antenna system 128 in accordance with the instructions. The information system controller 119 thereby can configure and control the antenna system 128 via the antenna status and control data 418.

As illustrated in FIG. 5, the antenna status and control data 418*a* can include satellite position data 520*a* for directing the antenna system 128. The antenna control system 500 likewise is shown as receiving vehicle position data 515. The vehicle position data 515 may be associated with a geographical position of the vehicle 111, which may be a stationary position and/or a position that changes with time where the vehicle 111 is traveling. The satellite position data 520*a* may include positional information regarding the position of the satellite system 310, which may be stationary (e.g., GEO satellite systems) and/or changing over time. Upon receiving vehicle position data 515 and the satellite position data 520*a*, the antenna control system 500 can compare the vehicle position data 515 and the satellite position data 520*a* to provide antenna control data 490 for orienting the antenna system 128 toward the satellite system 310. The antenna control data 490 may include line-of-sight values such as azimuth and elevation values as parameters for configuring (e.g., steering) the antenna system 128 to achieve a desired beam pointing direction. The antenna control system 500 can monitor the satellite position data 520*a* and/or vehicle position data 515 in real-time and adjust the orientation of the antenna system 128, as desired. Thereby, the antenna control system 500 can provide an open-loop system for orienting the antenna system 128 and maintaining communication between the antenna system 128 and the satellite system 310 during travel.

The antenna system 128 can be continually directed toward the satellite system 310 regardless of the position and/or orientation of the vehicle 111. Advantageously, the antenna control system 500 can maintain communication between the antenna system 128 and the satellite system 310 without requiring feedback, such as a signal strength determination, from the transceiver system 130. To further ensure the pointing accuracy of the antenna system 128, the antenna control system 500 can employ predictive algorithms, such as advanced second-order pointing algorithms, for directing the antenna system 128 toward the satellite system 310 as the vehicle 111 enters, and passes through, the associated coverage region of satellite system 310. For example, predictive algorithms may be employed as set forth in U.S. Pat. No. 7,715,783, entitled "SYSTEM AND METHOD FOR RECEIVING BROADCAST CONTENT ON A MOBILE PLATFORM DURING INTERNATIONAL TRAVEL," which is assigned to the assignee of the present application and the disclosure of which is hereby incorporated by reference in its entirety.

The vehicle position data 515 and the satellite position data 520*a* may be provided in any conventional manner. As illustrated in FIG. 5, vehicle position data 515 can be provided by a vehicle position system 510 included in antenna control system 500, such as a Global Positioning Satellite (GPS) system and/or an Inertial Reference System (IRS). Similarly, the satellite position data 520*a* can geographic location information, such as a Global Positioning Satellite (GPS) system and/or an Inertial Reference System (IRS). In some implementations, the satellite position data 520*a* includes a single longitudinal location, for example, where the satellite system 310 is a GEO satellite. In some embodiments, the satellite position data 520*a* may include geographic location information and ephemeris data for the satellite system 310 as stored by the server system 118 and provided to the antenna control system 500 via the distribution system 116. The server system 118 may include a database system for storing and maintaining the satellite position data 520*a* for a plurality of predetermined satellite systems 310. The server system 118 can store ephemeris data for any predetermined number of satellite systems 310, as desired. For example, where the satellite system 310 is consistently moving with respect to the earth (e.g., LEO, MEO, and HAPS) the satellite position data 520*a* may include ephemeris data. As an illustrative example, the satellite position data 520*a* can include GPS location, attitude, and rate of travel data of the satellite system 310. The antenna control system 500 may receive the satellite position data 520*a* (e.g., from a data bus line) and combine the satellite position data 520*a* with vehicle position data 515 (e.g., accelerometer data, GPS location, etc. of the vehicle 111), and compute line-of-sight values such as azimuth and elevation values for the antenna system 128 to achieve a desired beam pointing direction directed to the satellite. As another example, the antenna control system 500 may be supplied with external steering angle data, and use a communication link from the satellite system to refine the pointing accuracy.

The satellite systems 310, for example, includes at least one satellite system 310*a* and/or 310*b* having an associated coverage region through which the vehicle 111 may be expected to enter, and/or traverse. A database of the server system 118 may comprise a complete database of information for each satellite system within the expected region of travel for or stationary position of the vehicle 111. Illustrative database information can include the satellite position data 520*a*, an associated coverage region, transponder frequency data, signal polarization data, symbol rate data, video and/or audio program identification (PID) data, electronic program guide (EPG) data, forward error correction (FEC) data, and/or Program Clock Reference PID (PCR-PID) data during satellite handoff operations, without limitation. For each satellite system 310, the server system 118 can store at least one contour boundary that is based upon a predetermined signal strength (or signal power level). For instance, a contour boundary can approximate a coverage region having a contour boundary with an Effective Isotropic Radiated Power (EIRP) of approximately +48 dBW for each relevant satellite system 310

To help ensure that the antenna system 128 is directed toward, and configured to communicate with, the relevant satellite system 310, the antenna control system 500 continuously monitors the satellite position data 520*a* and/or vehicle position data 515 in real time and, as needed, provides control data 490 for adjusting the orientation of the antenna system 128 as needed. As shown in FIG. 5, the satellite position data 520*b* likewise can be provided by the antenna system 128. If the satellite system 310 includes a GEO satellite, for example, the satellite position data 520 can comprise a fixed geographical location (e.g., longitude and latitude coordinates, elevation, etc.) of the satellite system 310. If the satellite system 310 includes a moving satellite (e.g., LEO satellite, HAPS, etc.), for example, the antenna control system 500 can continuously monitor the satellite position data 520*a* in real time and, as needed, provide satellite position data 520*b* (e.g., geographical and elevation of orbit information) for adjusting the orientation of the antenna system 128 as needed. The satellite position data 520*b* can comprise real-time updated geographic location of the satellite system. As desired, the antenna control system 500 likewise can provide the information system controller 119 with antenna status data, the satellite position data 520*b*, and/or the vehicle position data 515 via the antenna status and control data 418*a*.

Upon receiving the antenna status data and control data 418*a* from the antenna control system 500, the information system controller 119 can compare the vehicle position data 515 with the appropriate contour boundary for the relevant satellite system 310. The information system controller 119 thereby can provide suitable antenna control data for directing the antenna system 128. If the vehicle position data 515 remains within the appropriate contour boundary for the current satellite system (e.g., satellite system 310*a*), the information system controller 119 can provide antenna control data for directing the antenna system 128 toward the current satellite system 310*a*.

Similarly, the information system controller 119 can provide antenna control data for directing the antenna system 128 toward a different satellite system (e.g., satellite system 310*b*) when the contour boundary of the current satellite system 310*a* approaches the position of the vehicle 111 based on the vehicle position data 515. The different satellite system 310*b* has a coverage region through which the vehicle 111 is expected to enter upon leaving the coverage region of the current satellite system 310*a*. The coverage region of the satellite system 310*a* and the satellite system 310*b* may overlap, and, while the vehicle 111 is within this overlap region, the antenna system 128 is configured to facilitate a handover with minimal, limited, or no interruption in service rendered (e.g., a soft handover). As the vehicle 111 exits a coverage region of the current satellite system 310*a* and the coverage region of satellite system 310*b* approaches the vehicle 111, the information system controller 119 provides first antenna control data 490 for continuing to direct the antenna system 128 toward the current satellite system 310*a* and provides second antenna control data 490 for continuing to direct the antenna system 128 toward the different satellite system 310*b*. In this way the antenna control system 500 can control the antenna system 128 to communicate with multiple satellites simultaneously.

As desired, the information system controller 119 likewise can monitor signal strength data associated with the received data signals 122. The signal strength data can be provided by the transceiver system 130 and communicated to the information system controller 119 and to the antenna control system 500 with the interface status and control data 418*a* and/or 418*b*. The information system controller 119 thereby can be configured to continuously monitor the signal strength data of the received data signals 122, preferably in conjunction with the vehicle position data 515. Thereby, if the signal strength data indicates that the signal strength of the received data signals 122 is below a predetermined signal strength level as the contour boundary of the current satellite system approaches the vehicle position data 515, the information system controller 119 can determine that the vehicle 111 is going to be beyond the range of the current satellite system 310*a*. The information system controller 119 therefore can provide antenna control data for directing the antenna system 128 toward a different satellite system 310*b* in the manner set forth above. In another embodiment, the information system controller 119 can compare the signal strength of a first satellite system 310*a* against a signal strength of a second satellite system 310*b* and determine to remain with the first satellite system 310*a* (e.g., where the signal strength is greater than that for the second satellite system 310*b*) and/or switch to the second satellite system 310*b* when the signal strength is greater than the first satellite system 310*a*, regardless of the position of the vehicle 111 within the coverage region.

Illustrative antenna control data 490 can include antenna azimuth data, antenna elevation data, and/or antenna polarization data for directing the antenna system 128 toward the appropriate satellite system 310. The information system controller 119 can provide the antenna control data to the satellite system 310 via the antenna status and control data 418*a* and/or 418*b*. The antenna control system 500 can receive the antenna control data 490 and can orient the antenna system 128 in accordance with the antenna control data 490. The antenna system 128 thereby can be continuously directed toward, and configured to communicate with, the relevant satellite system 310.

As desired, the antenna control system 500 can employ an optional feedback or closed-loop control system for orienting the antenna system 128 toward the satellite system 310. The antenna control system 500 can comprise a conventional feedback control system by receiving an antenna status signal with the interface status and control data, derived from signals as received from the satellite system 310. For example, the antenna status signal can represent signal strength of the signals 122 as received by the antenna system 128 as feedback for orienting the antenna system. The antenna control system 500 thereby can initialize and/or maintain the communication between the antenna system 128 and the satellite system 310.

In an illustrative example, the data signals 122 can include the content as described above in connection to FIG. 1. When the vehicle information system 100 is within the coverage region of the satellite system 310*a*, the antenna control system 500 orients the antenna system 128 toward the satellite system 310*a* such that communication between the antenna system 128 and the satellite system 310*a* is established and maintained. The antenna system 128 thereby can receive the data signals 122 and provide the content to the transceiver system 130. Upon receiving the data signals 122, the transceiver system 130 can convert the data signals 122 into content 134, within a predetermined frequency band, that is suitable for distribution throughout the vehicle information system 100 without significant signal degradation. The transceiver system 130 can provide the converted content 134 to the distribution system 116. The content 134 thereby can be selected for presentation and presented via the user interface systems 140 as described above.

For example, content may be beamed from the satellite system 310 to the antenna system 128. Upon receiving the data signals 122, the antenna system 128 can provide the received content to the transceiver system 130. The down-converter 152 can preprocess the received content in any conventional manner and provide the preprocessed content to the transceiver system 130. Illustrative preprocessing operations can include amplification and/or down-conversion of the received content without limitation. In an embodiment the received content may be received as a pair of high-frequency signals within the $K_u$- and/or K-$K_a$ Band, as described above in connection to FIG. 1, and are down-converted by the down-converter 152 into a pair of intermediate-frequency (or low-frequency) signals within a predetermined intermediate-frequency (or low-frequency) band, such as the L-Band. The transceiver system 130 can demodulate the data signals 122 via the demodulator 151 and decode the data signals 122 via the decoder 148. Upon down-converting, demodulating, and decoding the data signals 122, the transceiver system 130 can provide the processed content 134 to the content distribution system 116 for distribution throughout the system 100 without significant cable loss and/or signal degradation.

Reversely, content may be provided by the distribution system 116 to the antenna system 128 and beamed to the satellite system 310. Upon receiving the content 134, the up-converter 146 can process the content in any conventional manner. Illustrative processing operations can include modulating and/or up-conversion of the content without limitation. In an embodiment the content may be transmitted as a pair of intermediate-frequency (or low-frequency) signals within a predetermined intermediate-frequency (or low-frequency) band and are up-converted by the up-converter 146 into a pair of high-frequency signals within the $K_u$- and/or $K_a$-Band. The transceiver system 130 can modulate the content 134 via the modulator 144 and encode the content via the encoder 142 to generate processed content 134. Upon generating the processed content 134, the transceiver system 130 can provide the processed content 134 to the antenna system for beaming to the satellite system 310 as data signals 124.

Figure 6A:
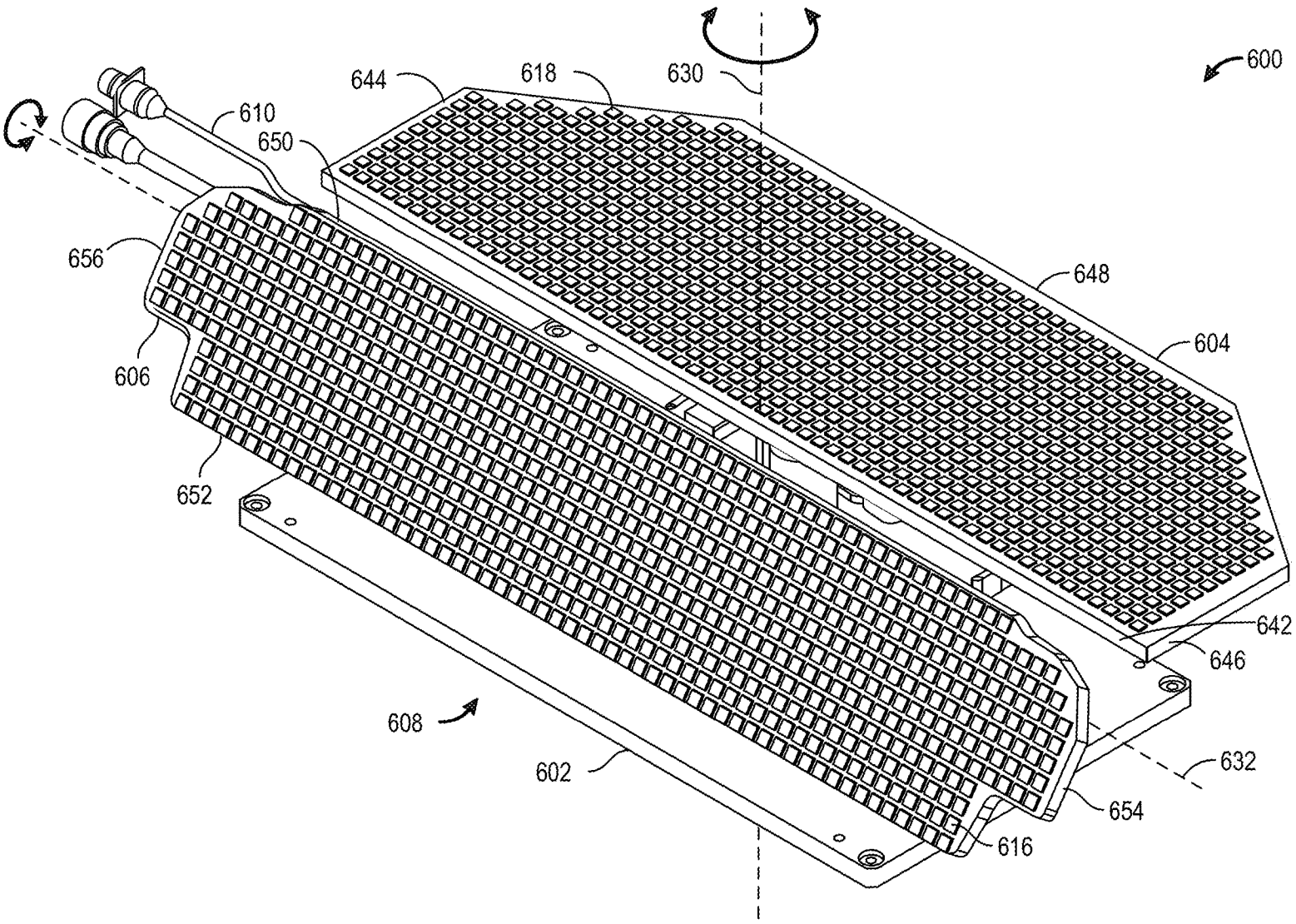
FIGS. 6A-6E are various views of an antenna assembly that may be installed in the vehicle communications system of FIG. 1, in accordance with various aspects of the present disclosure.
Figure 6B:
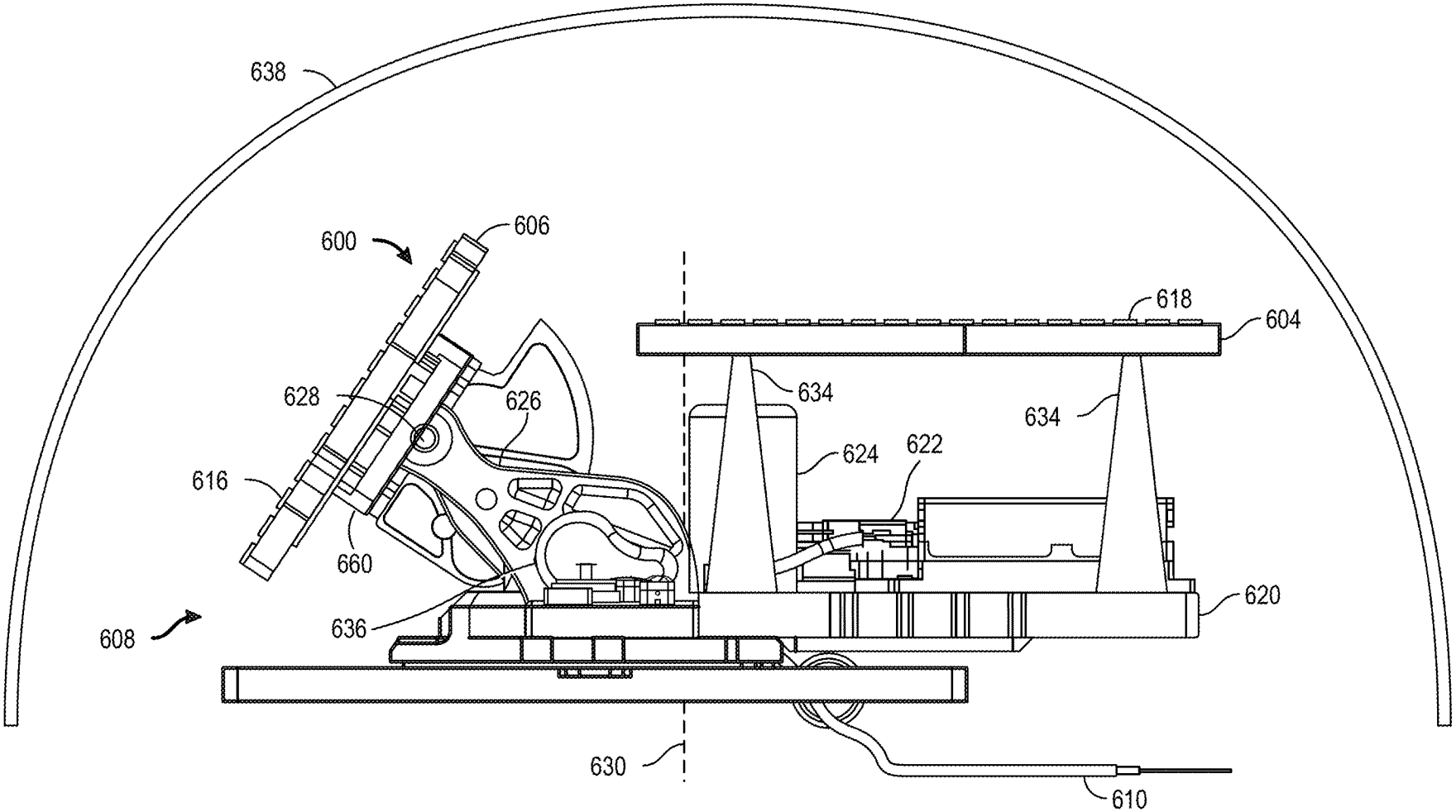
Figure 6C:
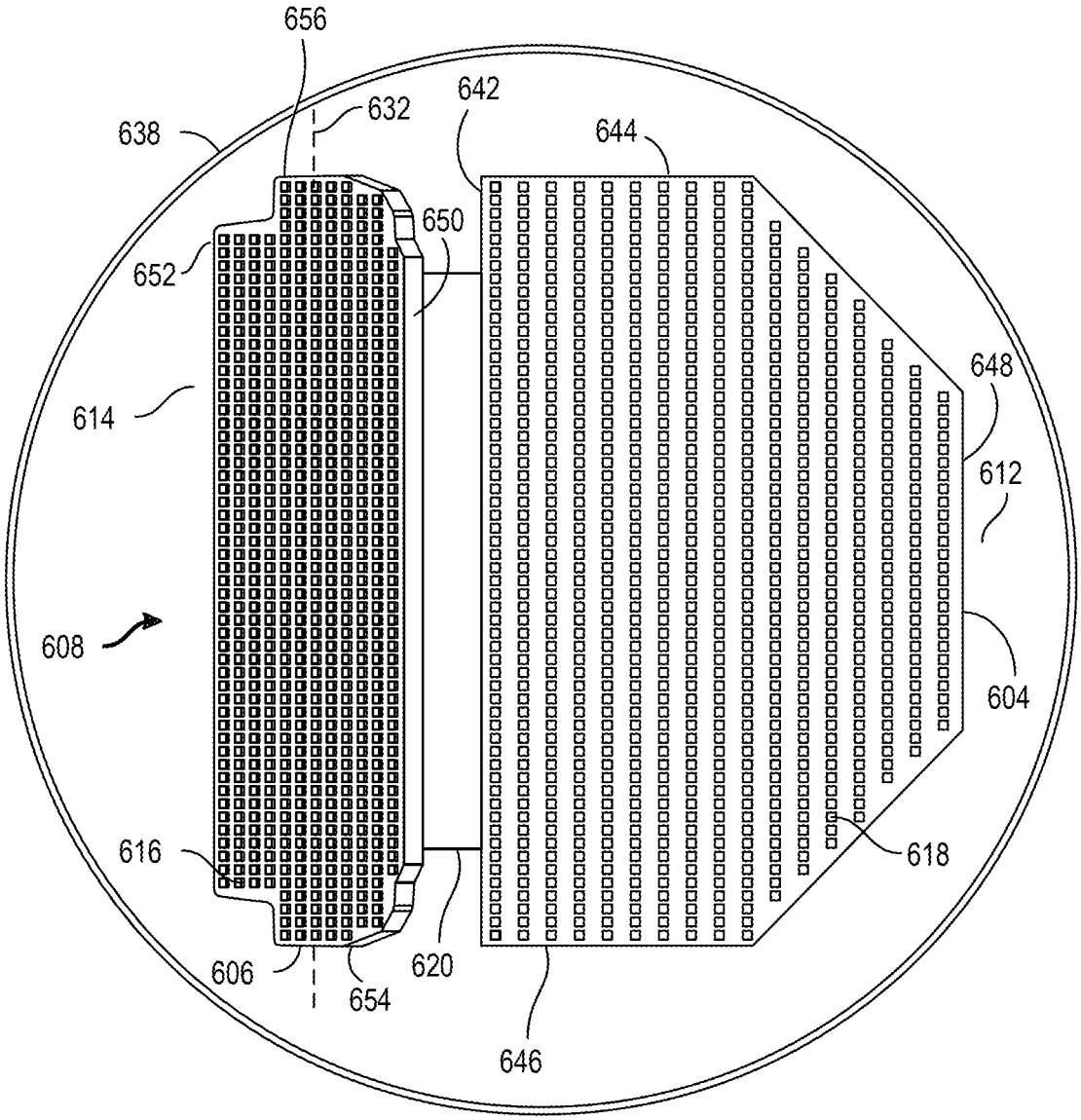
Figure 6D:
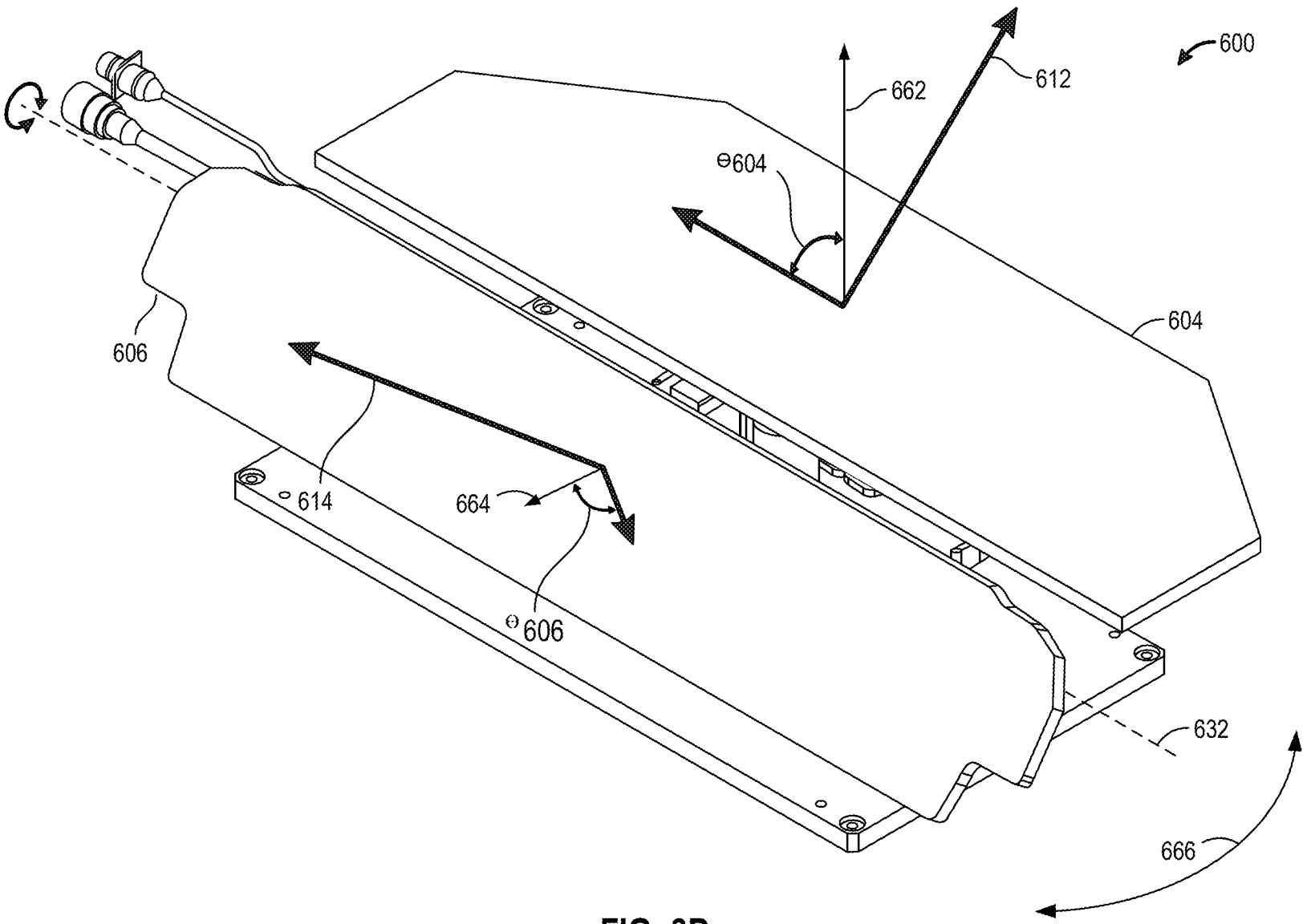
Figure 6E:
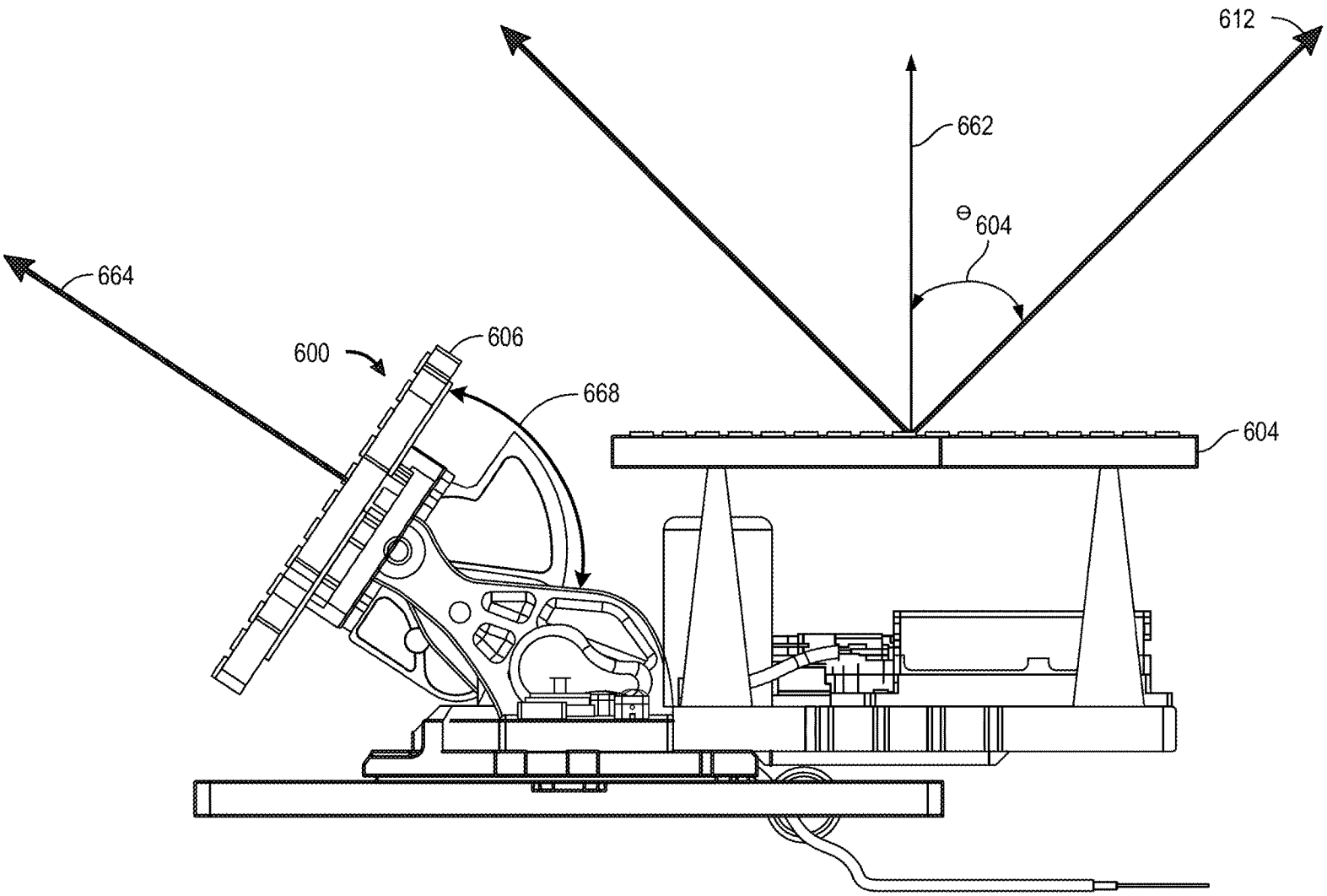

FIGS. 6A-6E are various views of an antenna assembly that may be installed in the vehicle communications system of FIG. 1, in accordance with various aspects of the present disclosure. FIG. 6A is a top, front perspective view of an antenna assembly 600 that may be included as part of antenna system 128 implemented in the system 100 of FIG. 1. FIG. 6B is a side view of the antenna assembly 600 and FIG. 6C is a top view of the antenna assembly 600. FIGS. 6D and 6E are reproductions of FIGS. 6A and 6B, respectively, with the references numbers removed and illustrating beam steering vectors for the antenna assembly.

The antenna assembly 600 may be positioned between a base plate 602 and a radome 638 (as shown in FIG. 6B). The base plate 602 may be attached to the vehicle 111, for example, via fasteners (e.g., screws, bolts, rivets, anchors, weldments, etc.) to the fuselage 132 of the vehicle 111 and the antenna assembly 600 positioned on a surface of the base plate 602 opposite the fuselage 132. In various embodiments, the antenna assembly 600 may be disposed under, and protected by, a radome 638. The radome 638 may be configured to provide aerodynamic protection for the antenna assembly 600 without impeding exchange of the data signals, such as signals 122 and 124. Thereby, the radio-frequency (RF) performance of the antenna assembly 600 can be optimized.

The antenna assembly 600 comprises a rotatable plate 620 coupled to the base plate 602. The rotatable plate 620 is rotatable relative to the base plate 602 about axis 630 so to point the front 608 of antenna assembly 600 toward a satellite (e.g., satellite system 310*a*) in azimuth. For example, a plane (not shown) that is parallel with the axis 630 and orthogonal to the rotatable plate 620 is steered to align with the satellite in azimuth. The rotatable plate 620 is rotatable using any suitable mechanical steering mechanism. For example, the rotatable plate 620 may be a plate or other structure coupled to one or more motor systems 624 suitable for inducing rotational movement to the rotatable plate 620. Suitable electromechanical transducers and/or actuators and associated mechanical linkage (and servo-controlled feedback systems) may be used to achieve such controllable rotational motions as will be appreciated by those in the art, and are illustratively shown in FIG. 6A as servomotor 624. Other motor systems may be employed, for example, but not limited to, stepper motor systems and the like as will be apparent to those in the art. In the illustrative embodiment, the rotatable plate 620 may be a rotatable yoke plate that is mechanically rotated about axis 630 through operation of the servomotor 624 (sometimes referred to herein as an azimuth servo motor).

The antenna assembly 600 comprises a plurality of panels, including at least a first panel 604 and a second panel 606, disposed on the rotatable plate 620. The first panel 604 is stationary (e.g., fixed) relative to the rotatable plate 620. For example, the first panel 604 (sometimes referred to herein as a fixed panel) is fixedly mounted to the rotatable plate 620 by brackets 634 or other means for fixedly coupling the panel 604 to the rotatable plate 620 such that the panel 604 is held stationary relative to the rotatable plate 620. In some embodiments, panel 604 may be a flat or planar structure that is substantially parallel to the rotatable plate 620 and/or the base plate 602 (referred to herein as horizontal). Thus, the plane parallel with the axis 630 may also be orthogonal to the first panel 604 such that the first panel 604 can be mechanically steered to align with the satellite in azimuth. The panel 604 may comprise a front facing surface or side 642, and a rear facing surface 648 connected to the front surface 642 by at least a first side surface 644 and a second side surface 646. The surfaces 642-648 may be any shape, such as for example, planar, arced, and the panel 604 is not limited to only surfaces 642-648, but are for illustrative purposes only. The rotatable plate 620 may be controlled to steer the first panel 604 to a plurality of azimuthal directions by rotating the antenna assembly 600. For example, the first panel 604 can be attached to the rotatable yoke plate that, via servomotor 624, is mechanically rotated about axis 630 to provide one degree of freedom in azimuth. Accordingly, servomotor 624 may be referred to as an azimuth servomotor.

The second panel 606 is also mounted to rotatable plate 620 via a mechanical mounting structure (illustratively shown as arm 626 and positioned adjacent to the first panel 604. Thus, the second panel 606 is also rotatable about axis 630, such that the panels 604 and 606 remain adjacent. The second panel 606 may comprise a front facing surface or side 652, and a rear facing surface 650 connected to the front surface 652 by at least a first side surface 654 and a second side surface 656. The surfaces 650-656 may be any shape, such as for example, planar, arced, and the panel 606 is not limited to only surfaces 650-652, but are for illustrative purposes only. In the illustrative example, the rear surface 650 of the second panel 606 is adjacent to the front surface 642 of the first panel 604. In various embodiments, at least a portion, and in some examples the majority, of the rear surface 650 is parallel to the front surface 642 along an axis that is perpendicular to the axis 630. Said another way, the surfaces 650 and 642 may be parallel along the axis 632, as shown in FIG. 6A-6C.

In the illustrative example, a proximal end of arm 626 may be attached to the rotatable plate 620 and the second panel 606 affixed to the distal end. The second panel 606 may be referred to herein as a front facing panel, because second panel 606 may be mechanically rotated in azimuth toward the satellite system based on mechanical rotation of the rotatable plate 620. The arm 626 includes a pivot point 628 between the rotatable plate 620 and the panel 606 for mechanically rotating the second panel 606 relative to the first panel 604 about axis 632. For example, the distal end of arm 626 may include a rotatable yoke plate 660 having the second panel 606 disposed thereon rotatable about axis 632 at pivot point 628. The rotatable yoke plate 660 may be rotated by servomotor 636 (sometimes referred to herein as an elevation servo motor) about axis 632 to provide a degree of freedom in elevation. For example, a second plane (not shown) parallel with the axis 630 and orthogonal to the second panel 606 is mechanically steered in elevation to align with the satellite. Thus, when combined with the rotation of plate 620, the second panel 606 may experience two degrees of freedom via mechanical rotation, e.g., one in azimuth via rotation of the rotatable plate 620 and one in elevation via the pivot point 628.

The second panel 606 may have a substantially flat or planar structure as illustrated. For example, in a first position, the second panel 606 may be substantially parallel to the first panel 604, and a top surface of the second panel 606 may be aligned with a top surface of the first panel 604. In a second position, the second panel 606 may be perpendicular to the first panel 604 such that it faces completely toward the front 608 of the antenna assembly 600. Furthermore, the arm 626 may be controlled to position the second panel 606 at any position between the first and second position, thereby steering the second panel 606 in a plurality of elevation angles relative to the first panel 604.

Rotatable plate 620 and panels 604 and 606 are respectively movable, as described above, under control of an antenna controller (see, e.g., antenna controller 830 of FIG. 8) housed in controller housing 622. The rotatable plate 620, and thus the panels 606 and 604, may be controlled to rotate about axis 630 to mechanically steer a beam pointing direction for a first beam of radio waves in azimuth. For example, FIGS. 6D and 6E illustrates steering vectors 612 representing a range of angles, relative to normal 662, for beam point directions for first beam of radio waves of the first panel 604. The steering vectors 612 are aligned with the plane that parallel to the axis 630 and orthogonal to the panel 604. In some embodiments, rotatable plate 620 is controlled so to rotate the first panel 604 around the axis 630 and thereby adjust its respective beam pointing direction in azimuth. For example, an azimuth servo motor may induce mechanical rotation (e.g., arrow 666) of the antenna assembly 600 to provide one degree of freedom in azimuth. Thus, the steering vectors 612 are also rotated about axis 630 (as shown by arrow 666) based on mechanical rotation applied to the antenna assembly 600. Additionally, or separately, second panel 606 can be controllably rotated around axis 632 at pivot point 628 to adjust its respective beam pointing direction for a second beam of radio waves in elevation. For example, FIGS. 6D and 6E illustrates steering vectors 614 representing a range of angles, relative to normal 664 of the second panel 606, for beam point directions for the second beam of radio waves of the second panel 606. The steering vectors 614 are aligned with the plane that parallel to the axis 632 and orthogonal to the panel 606. Thus, second panel 606 is controlled so to rotate the around the axis 630 (e.g., arrow 668) and thereby adjust its respective beam pointing direction in elevation. For example, an elevation servo motor may induce mechanical rotation (e.g., arrow 668) of a rotatable yoke plate about pivot point 628 to provide another degree of freedom in elevation for the second panel 606. It will be understood that elevation angles are typically measured from a horizontal (or vertical), which may or may not coincide with the orientation of the base plate 602 (or perpendicular thereto). It will also be understood that azimuth angles typically define a direction of a celestial object (e.g., the earth) from the observer (e.g., the antenna assembly 600), measured as the angular distance from a point of the horizon (e.g., typically north or south) to the point at which a vertical circle passing through the object intersects the horizon.

Each panel 604 and 606 includes a phased array of a plurality of antenna elements 618 and 616, respectively. For reduced manufacturing and replacement cost, each of antenna element 618 may be substantially identical to one another in shape and/or size and each of antenna element 616 may be substantially identical to one another in shape and/or size. Each antenna element may correspond substantially in shape to a polygon, such as, for example, a parallelogram, a rectangle, a square, hexagon, etc. Other shapes may be used as well, such as circles, triangles, rectangles, etc. In general, shapes are preferred that can be placed together without overlapping or leaving gaps between antenna elements, e.g., shapes in which tessellation is possible. There are many possible designs for arrayed antenna elements, for example, but not limited to leaky cavity array, patch array, close coupled dipole array, etc.

The antenna elements 618 and 616 are disposed on the planar top of each panel 604 and 606, respectively. As illustrated, each panel 604 and 606 comprises a polygon shape that may be different and/or identical and include outer boundaries. Thus, the antenna elements 618 and 616 need not evenly meet the boundaries of each respective panel and some gaps may be left along the boundaries of each respective panel. For applications where higher gain is desired, additional antenna elements 618 and/or 616 may be added and/or specially shaped for more complete coverage and/or the size and shape of each panel may be modified to permit the desired additions or substation of antenna elements. In various implementations, for maximum performance, the antenna elements may be evenly distributed and set at a constant pitch. The pitch may be based on the operating frequency band, for example, the pitch may be less than one-half of the wavelength of the operating band. However, it will be appreciated that embodiments herein are not to be limited as such, and are provided merely as illustrative examples. For example, one possible implementation is to omit a carefully-selected and apparently random selection of elements in what may be referred to as a "thinned array", which may reduce costs and heat dissipation while maintaining a tight beam shape.

Each antenna element may be a radiating element cell, i.e., the smallest building block or component of an antenna array and is wideband. Each antenna element may be implemented by using bipolar radiators (vertical and horizontal). Each antenna element can be selectively controlled (e.g., as described below) to emit a beam of radio waves in a single plane or conical surface. A radio frequency current from the transceiver system 130 is fed to each individual antenna element with a desired phase relationship so that the radio waves from each antenna element adds together to increase the radiation in a desired beam pointing direction, while canceling to suppress radiation in undesired directions. As such, each panel 606 and 604 may aggregate the individual radio waves from the antenna elements to form a first or second beam of radio waves, respectively, that can be electrically steered to a desired beam pointing direction (e.g., along vectors 612 and 614, respectively) based on selective control of the antenna elements, without having to physically move the antenna elements. The antenna elements may have polygonal or circular apertures but are preferably square and arranged as a horn array for greater bandwidth. The antenna elements may be dual edge-fed, pin-fed, EM-coupled or other patch type configured to operate as a phased array as is known in the art.

The plurality of antenna elements can be electrically scanned so to steer a beam of radio waves over respective ranges of angles relative to normal of a planar surface of the each respective panel on which the antenna elements are disposed. That is, panel 604 comprises antenna elements 618 arranged as phased array antenna elements, which can be electrically scanned, for example, to steer the beam pointing direction of a first beam of radio waves in elevation over a wide range of angles ($\theta_{604}$) relative to normal 662 within steering vector 612. Similarly, panel 606 comprises antenna elements 616 that may be electrically scanned, for example to steer the beam pointing direction of a second beam of radio waves in azimuth over a wide range of angles ($\theta_{606}$) relative to normal 664 within steering vector 614. Each steering vector sweeps the respective range of angles aligned along the respective plane that interests the mechanical rotation axis and is orthogonal to the planar surface of each respective panel. Pointing directions may be any direction within the range angles of $\theta_{604}$ and $\theta_{606}$, thus pointing beams of radio waves of the first panel 604 in elevation and the second panel 606 in azimuth. It will be understood that the angle $\theta_{606}$ is not strictly an azimuth angle, because the geometry mixes the elevation and azimuth angles together.

Figure 7A:
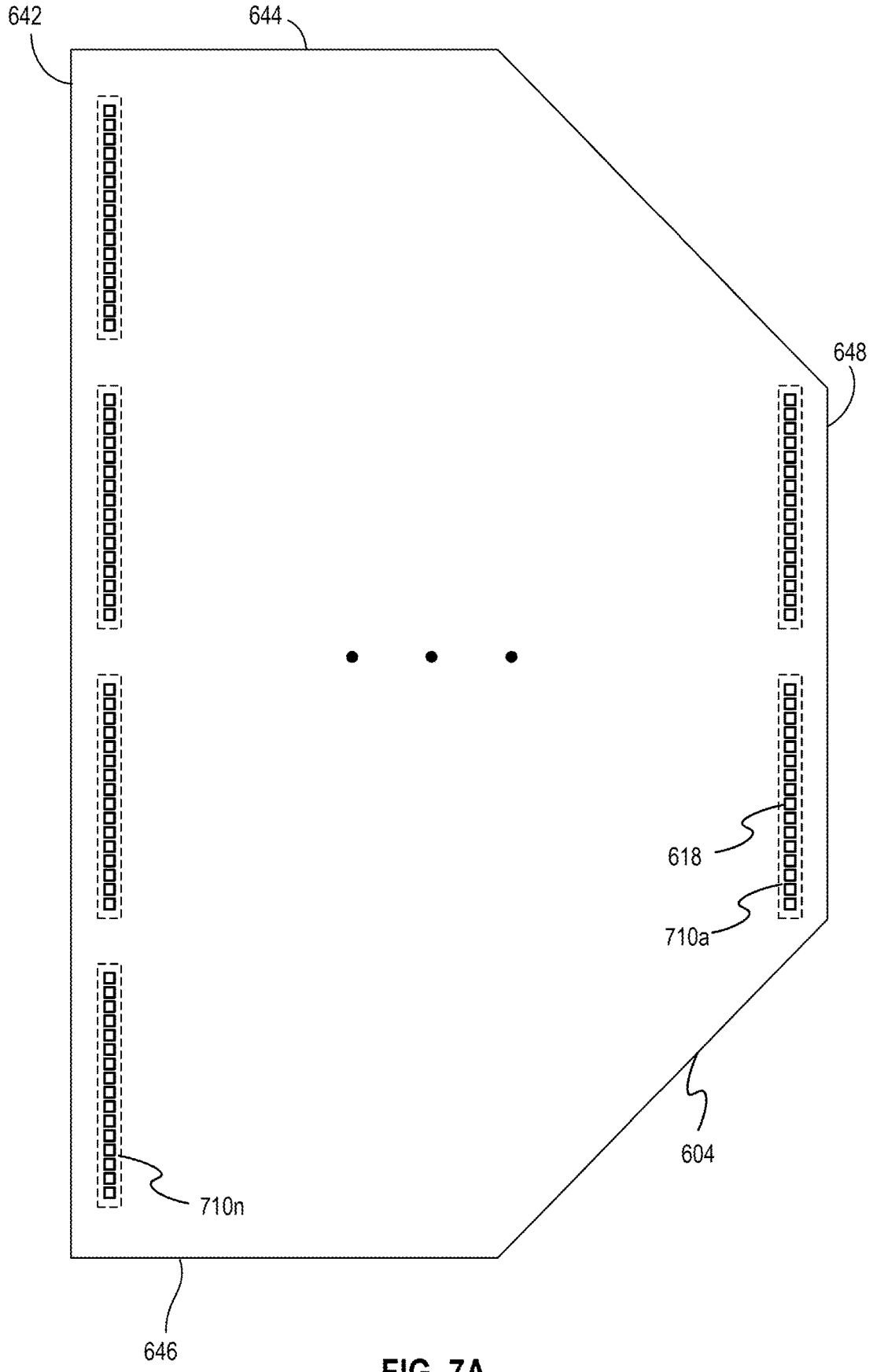
FIGS. 7A and 7B are schematic diagrams illustrating example panels for use in the antenna assembly of FIGS. 6A-6C, in accordance with various aspects of the present disclosure.
Figure 7B:
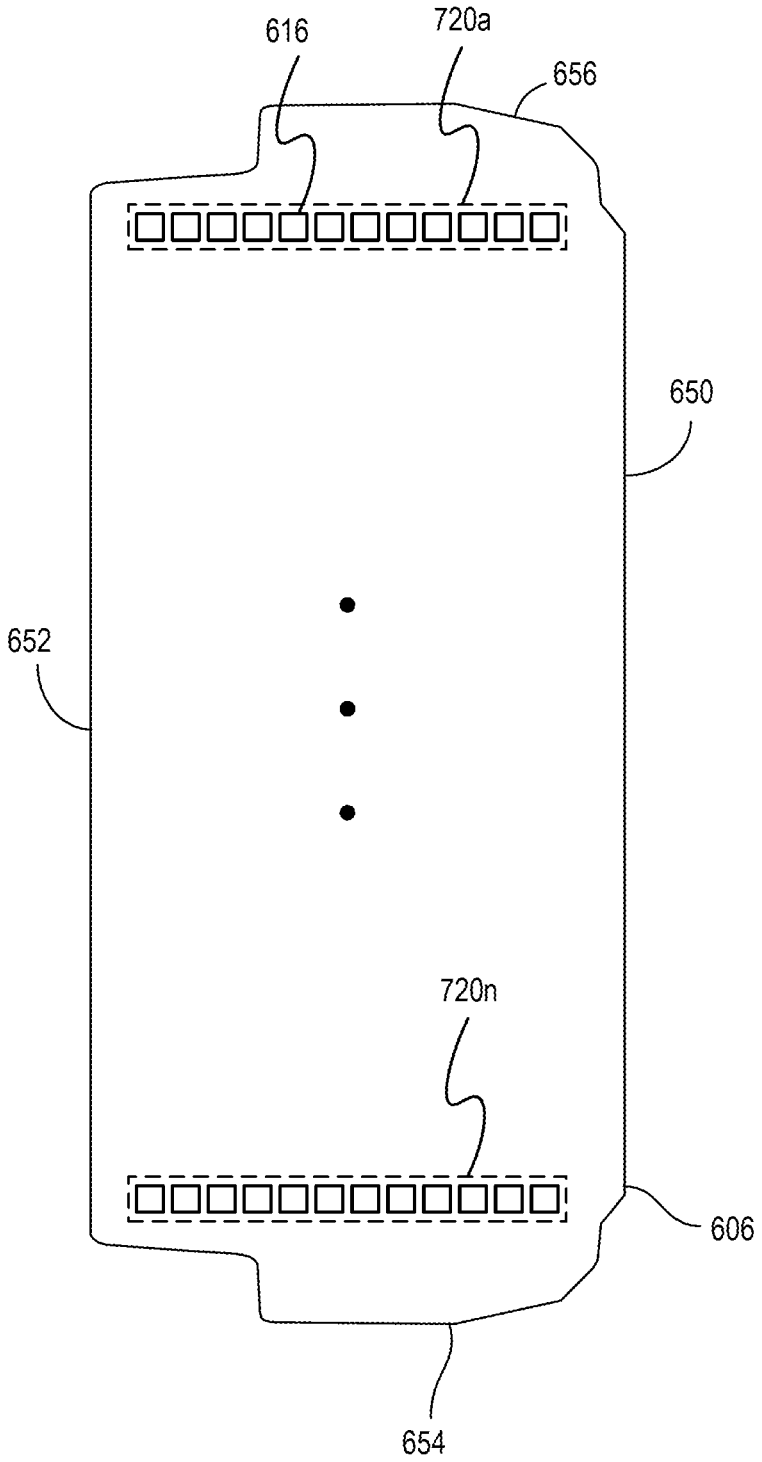

In various embodiments, antenna elements 618 of panel 604 can be ganged in rows to achieve the fore-and-aft beam sweep, as described above, in accordance with their phasing. Similarly, the antenna elements 616 of panel 606 can be ganged in columns and, by a similar phasing arrangement, can be made to sweep a beam side-to-side. For example, as schematically illustrated in FIGS. 7A and 7B, each panel 604 and 606 comprises a phased array made up of a plurality of element groups 710 and 720, each comprising a subset of the antenna elements 618 and 616, respectively, that are ganged together. Each element group 710 may be commonly controlled, such that each antenna element 618 of a respective element group 710 is operated at common operating parameters (e.g., phase, amplitude, and polarity). Similarly, each element group 720 may be commonly controlled, such that each antenna element 616 of a respective element group 720 is operated at common operating parameters (e.g., phase, amplitude, and polarity).

In various embodiments, each element group 710 may comprise an array of M by N antenna elements and each element group 720 may comprise an array of Y by X antenna elements, where M, N, Y and X are integers. Embodiments here are not limited to any specific number of antenna elements, such that M, N, X, and Y may be any integer. For example, in some embodiments, an element group 710 and 720 may include all antenna elements of a given row and/or column, while in another embodiment, an element group may include a subset of the antenna elements of a given row and/or column. Thus, each row and/or column may comprise one or more element groups 710 and 720. In the illustrative example, M may be one and N may be 16, such that the element group 710 includes a total of 16 antenna elements 618. Also, X may be one and Y may be 12, such that the element group 720 includes a total of 12 antenna elements 616, e.g., a one-by-12 array. More or less elements may be provided depending upon the intended application and power consumption requirement and/or restrictions. Each panel 604 and 606 may comprise a printed circuit board material, upon which the antenna elements 616 and 618 are mounted As illustrated in FIG. 7A, the element group 710 may be oriented along a row, for example, parallel to the front surface 642 of panel 604. Thus, the direction of the range of angles ($\theta_{604}$) through which the beam of radio waves for the first panel 604 are scanned is across columns of the element group 710 (e.g., as shown in FIGS. 6D-6E). As illustrated in FIG. 7B, the element group 720 may be oriented along a column, for example, perpendicular to the front surface 652 of panel 606 and thus perpendicular to axis 632. Thus, the direction of the range of angles ($\theta_{606}$) through which beam of radio waves for the second panel 606 are scanned is across rows of the element groups 720 (e.g., as shown in FIGS. 6D-6E).

By leveraging the mechanical rotation of the antenna assembly 600 and panel 606 as described above, each panel need only use one-dimensional scanning. That is each panel may comprise a phased array capable of scanning in a single direction as described above. Whereas, conventional phased array antennas had to include multiple phased arrays on a single panel to facilitate scanning in two or more directions. Each phased array included its own set of antenna elements, thus a single panel would be required to have a matric of thousands of elements. Thus, operation of such phased array antennas consumes far more power and result in significant heat waste to must be dissipated. Advantageously, embodiments herein provide for significantly lower power requirements and reduced heat waste since one-dimensional electronic scanning is employed in combination with mechanically rotated steering.

For the convenience of illustration, only six element groups 710 and two element groups 720 are illustrated in each panel 604 and 606. The remaining element groups are presented by the ellipsis, indicating rows and columns of antenna elements, each having a common orientation and phased array. Furthermore, while rectangular element groups are illustrated herein, the panels 606 and 604 may comprise any number of antenna elements as desired for application and performance. That is, the element groups may comprise any number of antenna elements by any number of antenna elements as desired Since each phased array may be configured for control of phase and amplitude of each element group 710, 720 and not necessarily by individual elements, embodiments herein may provide the benefit of reduced heat consumption, compared to having an element-by-element electronically steered array. Each column or row may be divided into a plurality of element groups (as described above) such that, for example, each row is divided into two or three separate parts. This might be done to allow a few degrees of electronic steering on a plane perpendicular to the main steering plane, such that fine beam forming or steering may be accomplished independently of the mechanical steering arrangement.

Returning to FIGS. 6A-6C, the antenna controller housed in housing 622 may include conventional electrical control circuitry (e.g., microprocessor controlled) to achieve controlled accurate adjustment of electromechanical actuators (e.g., servomotors 636 and 624) and antenna elements 618 and 616. For example, controller may optionally control movement of panels 606 and 604 responsive to movements of the satellite system 310 relative to the vehicle 111 on which antenna assembly 600 is mounted (e.g., based on control data as described above), such that respective beam pointing directions of panels 604 and 606 are constantly directed toward a desired satellite system in both azimuth and elevation (e.g., using suitable beam tracking feedback control circuits driven by received RF signal strength as described above in connection to FIGS. 4 and 5). In various implementations of phased array antenna elements, the steering vector may have off normal angles (e.g., $\theta_{604}$ and $\theta_{606}$) limited to approximately 65-70 degrees, based on the performance of the individual antenna element and that the beam width tends to spread in elevation beam point direction approaches the horizon (e.g., is reduced). In various embodiments, the second panel 606 may be able to achieve lower elevation pointing directions based on the mechanical rotation about pivot point 628, since normal 668 can be pointed in elevation thereby facilitating lower elevation off normal angles. Thus, the second panel 606 may be beneficial for vehicles flying at high latitudes.

The antenna controller, as described below, may include suitable controls for substantially any type of driving actuator, such as a pneumatic actuator, electrical actuator or a linear or rotary motor with suitable mechanical transmission linkage. The driving actuator may be linear or non-linear. As will be appreciated, the mechanical actuators are mechanically linked to the antenna apparatus so as to control pivoting and/or other motions as required.

The antenna assembly 600 may be communicatively coupled (e.g., through a wired or wireless connection) to the vehicle information system 100 of FIG. 1. For example, as illustrated in FIGS. 6A-6C, the antenna assembly 600 includes a wired connection 610 to electrically connect the antenna assembly 600 to the vehicle information system 100 for passing received signals to the vehicle information system 100 and passing signals from the vehicle information system 100 to the satellite system. In various embodiments, the wired connection 610 may comprise a first connection electrically coupled to the antenna controller hosed in controller housing 622 and to one or more connecting device 640, such as a slip ring, rotary joint, or the like, that allows for exchange of power, data signals, or other electrical signals from the rotatable plate 620 to downstream components that are stationary relative to the rotatable plate 620.

In various embodiments, the antenna assembly 600 is sized and shaped to fit within the space specified by the ARINC 791 standard, at least for wide-body aircraft. The ARINC 791 standard provides for a length L of 2370.6 mm and a maximum width W of 1121.2 mm. The ARINC 791 standard further provides for a height H of 140.0 mm and a thickness T of 54.0 mm. Due to curvature, in some embodiments, the width W is narrower in the forward direction of the vehicle. In various embodiments, the radome 638 may be a teardrop or loft shape. In some embodiments, the antenna assembly is sized and shaped to fit within a space that is slightly lower than the ARINC 791 standard (e.g., radome provided on aircrafts designed by Boeing®)

While illustrative embodiments herein depict an antenna assembly comprising two panels, it will be appreciated that the scope of the present disclosure is not limited to two panel antennas. Instead, antenna assemblies disclosed herein may comprise any number of panels, for example, three, four, five, etc. Antenna assemblies disclosed herein may include one or more stationary panels that are similar to panel 604 and one or more rotatable panels that are similar to panel 606. Thus, through the use of multiple panels, the antenna assemblies herein may communicate with a plurality of satellite systems while simultaneously switching between the same or different satellites systems.

Figure 8:
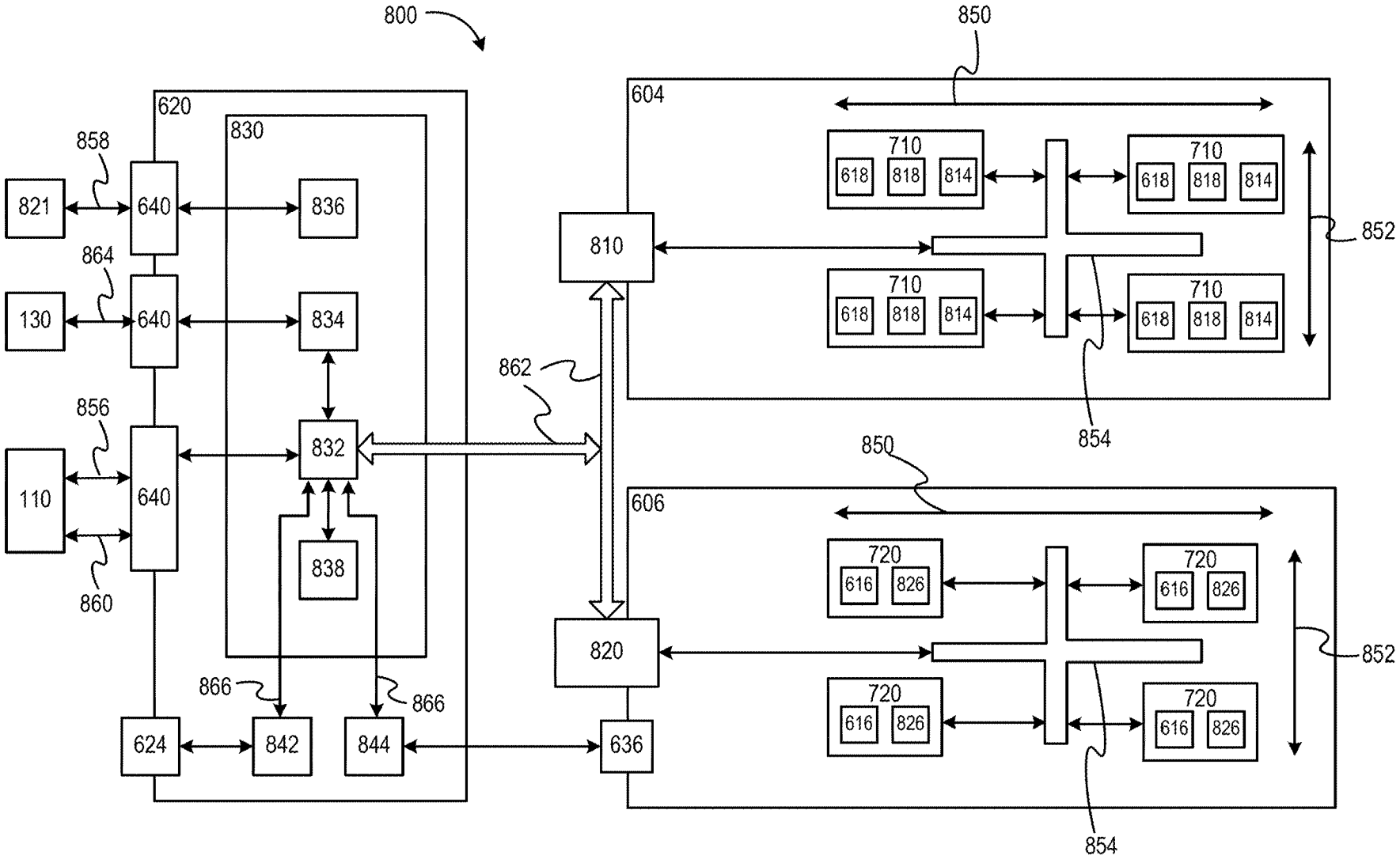
FIG. 8 is a schematic block diagram illustrating the antenna assembly of FIGS. 6A-6E, in accordance with various aspects of the present disclosure.

FIG. 8 is a schematic block diagram illustrating the antenna assembly of FIGS. 6A-6E, in accordance with various aspects of the present disclosure. FIG. 8 depicts the antenna assembly 600 comprising an antenna controller 830 (e.g., housed in controller housing 622 of FIG. 6B) disposed on the rotatable plate 620. The antenna controller 830 may be coupled to panel controller systems 810 and 820 for controlling panels 604 and 606, respectively. In accordance with the embodiments herein, the antenna controller 830 comprises a mechanical control comprising electromechanical actuators and transducers, such as, servomotors 624 and 636, management information base (MIB) 838, and servo encoders 842 and 844 corresponding to the servomotors 624 and 636, respectively. The antenna controller 830 also comprises an electrical control system comprising a digital signal processor (DSP) circuit 832 and panel controller systems 820 and 810 for controlling each of panels 604 and 606, respectively.

The antenna controller 830 may be controlled by a master controller (e.g., the antenna control system 500), for example, based on control data 490 as described above in connection to FIGS. 4 and 5. In some embodiments antenna controller 830 may include the antenna control system 500. In another embodiment, the antenna controller 830 may be communicably coupled to the antenna control system via a connecting device 640. In such an embodiment, the antenna control system 500 may communicate control data 490 to antenna controller 830 over a high speed bus line 856 (e.g., an ARINC data bus line)), which operates the mechanical and electrical control system to configure the antenna assembly in accordance with the control data 490. The high speed base line may be implemented as a high speed USB, Ethernet, or optical fiber connection.

While multiple connecting devices 640 are illustrated in FIG. 8, it will be appreciated that the antenna assembly 600 may comprises any number of connecting device 640 necessary to connect the components thereof to the downstream components of system 100. In some embodiments, there may be one connecting device 640 which provides for connecting all components of antenna assembly 600 to the downstream components. In another embodiment, each component may be connected to a downstream component via a distinct and separate connecting device 640.

Turning to the electrical control system, each panel 604 and 606 may include panel controller systems 810 and 820 connected to the panel 604 and 606, respectively. The panel controller systems 810 and 820 of each panel 604 and 606 is configured to selectively activate and deactivate each of its antenna elements 618 and 616 by commonly activating and deactivating the element groups 710 and 720 of each panel. For the convenience of illustration, only four element groups 710 and 720 are illustrated in each panel 604 and 606. The remaining element groups are presented by the solid black double headed arrows 850 and 852, indicating rows and columns of element groups with each having a group controller. The high speed bus 854 may be implemented as a high speed USB or Ethernet connection. Each element group 710 may also include one or more of low-noise amplifiers (LNAs) 814 for amplifying a pair of oppositely-polarized signals exchanged with a satellite system.

The antenna controller 830 may be provided as part of rotatable plate 620, which may include a DC power distribution network 836 based on an AC/DC power supply from the vehicle (typically 48 VDC for aircraft) 821 provided over a power supply line 858. The power distribution network 836 may comprise a power management system configured to monitor and balance power usage and perform power management housekeeping processes. The antenna controller 830 may also communicate information with downstream components of the system 100. For example, in some embodiments, the transceiver system 130, which may include an on-board modem, antenna control system 500 and the vehicle position system 510, which can provide full data (GPS location and vehicle positioning) for satellite tracking as described above, may be coupled through a connecting device 640. In some embodiments, one or more components of or the entire transceiver system 130 may be integrated within the antenna assembly 600 as part of the antenna controller 830 and/or panels 604 and 606. For example, a modulator 144 and/or demodulator 151 may be included with each element group 710 and 720 and/or elsewhere within antenna controller 830 for modulating and demodulating signals at each element group. Up- and down-converters 146 and 152 may also be included at each element group 710 and 720 and/or antenna controller 830. Similarly, the antenna control system 500 and/or the vehicle position system 510 may be integrated into the antenna controller 830.

The antenna controller 830 is responsible for overall control of the rotatable plate 620 and each of panels 604 and 606, line-of-sight calculations, built-in testing and test equipment (BIT/BITE) management, and communication with external downstream components of the system 100. The antenna controller 830 may communicate with downstream components via bus line 864, such as Ethernet lines (100 Base-T or faster) and/or fiber optic lines using simple network management protocol (SNMP) and/or proprietary protocol(s) to other types of controllers, such as maintenance controllers.

The antenna controller 830 is also in communication with an ARINC 429 bus 860 from the vehicle 111, for example, for using vehicle navigation data to compute beam pointing directions as azimuth, elevation and polarity values as described herein. The ARINC 429 bus 860 may be coupled to the vehicle position system 510 either separate from antenna controller 830 and/or integrated into antenna controller 830.

The antenna controller 830 may include a modem as either part of or separate from the transceiver system 130, which may be based on the DVB-S2 standard (or later version), BC-03, 5G non-terrestrial network modems, etc., and provides the antenna controller 830 with information about pointing accuracy, such as received signal to noise ratio (SNR) and signal strength. The modem may also be used as a main or master modem replacing the modem of the transceiver system 130. In either situation, the modem can provide the antenna controller 830, such as information about TDMA timing, so that the antenna controller 830 can switch transmission on and off and reducing total average power consumption.

The panel controller systems 810 and 820 of each panel 604 and 606 receive the computed line-of-sight values, e.g., elevation, azimuth, and polarity information, for controlling the respective beam pointing directions along steering vectors 612 and 614, along with other information from the antenna controller 830 over high speed bus lines 862. The line-of-sight values may be included with or as part of the control date 490 of FIGS. 4 and 5. The information is computed and provided by the antenna controller 830 at least as frequently as every 20 milliseconds, more preferably at least every 10 milliseconds, and even more preferably at least every 5 milliseconds.

Each panel controller system 810 and 820 uses the line-of-sight values to determine the configuration for each element group 710 and 720 for achieving the beam pointing directions and communicates the configuration to a group controller 818 and 826 on each element group 710 and 720, respectively, over a high speed bus 854. In the embodiments herein, the panel controller system 810 (sometimes referred to herein as an elevation control system 810) uses elevation and polarity line-of-sight values to determine the configuration for each element group 710 to steer the beam pointing direction of panel 604 to the desired elevation and communicates the configuration to a group controller 818 on each element group 710, respectively, over a high speed bus 854. Skew control may also be implemented based on the polarity information for each element group 710. Similarly, the panel controller system 820 (sometimes referred to herein as an azimuth control system 820) may use azimuth and polarity line-of-sight values to determine the configuration for each element group 720 to steer the beam pointing direction of panel 606 to the desired azimuth and communicates the configuration to a controller 826 on each element group 720, respectively, over a high speed bus 854. Skew control may also be implemented based on the polarity information for each element group 720.

The panel controller system 810 and 820 for each panel identifies an antenna element 618 and 616, respectively, by its location or position in the respective panel, and provides an initial phase that is in common with other elements in its respective element group. Each group controller 818 and 826 selectively controls (e.g., activates and deactivates) the respective element group 710 and 720 based on instructions from its respective panel controller system 810 and 820. Steering or pointing is performed by two processes running in parallel: (i) coarse pointing performed by the panel controller systems 810 and 820 based on group element mapping and phase distribution; and (ii) fine pointing performed by each group controller 818 and 826 based the phase and amplitude distribution of the antenna elements of its corresponding element group 710 and 720. Each group controller 818 and 826 performs phase and amplitude adjustments for its respective element group 710 and 720 as required by the azimuth, elevation, and polarity values communicated to it from its respective panel controller system 810 and 820. Each group controller 818 and 826 may be implemented as control software or as a separate component.

Turning to the mechanical control system, each panel 604 and 606 is physically coupled to one or more servomotors 636 and/or 624, which are rotary and/or linear actuators to provide for precise control of angular and/or linear position, velocity, and acceleration. In the illustrative example, the panels 604 and 606 are physically coupled to servomotor 624 by mounting to the rotatable plate 620, and the panel 606 is physically coupled to the servomotors 636 via arm 626. The antenna controller 830 includes the MIB 838 configured, for example, as a hierarchical virtual database of information describing the servomotors 636 and 624 controlled by the antenna controller 830. In various embodiments, the MIB 838 uses SNMP, remote monitoring 1 (RMON1), proprietary protocol(s), and/or other protocols known in the art. The DSP circuit 832 is in communication with servo encoders 842 and 842, for example, over high speed bus lines 866, such as a high speed USB or Ethernet connection. The antenna controller 830 is configured to selectively move the rotatable plate 620 and/or panel 606 by accessing the MIB 838 and driving the servomotors 636 and/or 624 based on the definitions in the MIB 838 and line-of-sight values received from the antenna control system 500. Servo encoders 842 and 844 provide position and speed feedback to the DSP circuit 832 to provide for closed-loop (e.g., feedback) control of the servomotors 636 and 624, respectively.

The servomotors 636 and 624 may be coupled to the DC power distribution network based on an AC/DC power 821 via the power distribution network 836. As described above, the antenna controller 830 may also communicate information with the transceiver system 130 and with the antenna control system 500 for satellite tracking as described above. The antenna controller 830 is responsible for overall control of the rotatable plate 620 and each panel 604 and 606 based on line-of-sight calculations. The antenna controller 830 also uses vehicle navigation data to compute antenna pointing values as described above.

The antenna controller 830 (e.g., via the DSP circuit 832) receives the computed line-of-sight values, e.g., elevation and azimuth, for steering the respective beam pointing directions, along with other information from the antenna controller 830. For example, steering normal 668 in elevation to a satellite system and steering the plane aligned with steer vector 612 in azimuth to a satellite system. The information is computed and provided by the antenna controller 830 at least as frequently as every 20 milliseconds, more preferably at least every 10 milliseconds, and even more preferably at least every 5 milliseconds. The antenna controller 830 uses this information to determine the configuration for the panels 604 and 606 for achieving the beam pointing directions and communicates the configuration to the servomotors 636 and 636 over a high speed bus line 866. In the embodiments herein, the antenna controller 830 uses elevation line-of-sight values to determine the configuration servomotor 636 for steering the beam pointing direction of panel 606 to the desired elevation and communicates the configuration to the servomotor 636 (sometimes referred to herein as an elevation servomotor) under closed-loop control using servo encoder 844 (sometimes referred to herein as an elevation encoder). Similarly, the antenna controller 830 uses azimuth line-of-sight values to determine the configuration servomotor 624 for steering the antenna assembly 600 (and thus the beam pointing direction of panel 604) to the desired azimuth and communicates the configuration to the servomotor 624 (sometimes referred to herein as an azimuth servomotor) under closed-loop control using servo encoder 842 (sometimes referred to herein as an azimuth encoder).

Each servomotor 624 and 636 controls the rotatable plate 620 and panel 606, respectively, based on instructions from the DSP circuit 832 and respective servo encoder 842 and 844. Steering or pointing is performed by two processes running in parallel: (i) coarse pointing performed by the antenna controller 830 based on elevation/azimuth information and phase distribution; and (ii) closed-loop control based on position and speed feedback from the servo encoders 842 and 844, as well as phase and amplitude distribution from respective array 710 and 720 to narrow in on line-of-sight boresight alignment. Each servomotor 636 and 624 performs azimuth and elevation adjustments, respectively, for its respective panel 604 and 606 as required by closed-loop monitoring of azimuth and elevation values communicated from the antenna controller 830 to achieve peak amplitude of received signals from the satellite system.

It will be understood that the, the computed line-of-sight values and values for controlling the servomotors 636 and 624, as well as the values for controlling group elements 710 and 720, for setting their respective angles may not correspond one-to-one with the azimuth and elevation angles of the respective satellite. The values provided to the various controllers are calculated so to configure and otherwise control the mechanical rotation and electrical steering of the panels 606 and 604 so to align each panel with a desired satellite system on boresight based on determined line-of-sight values.

Figure 9:
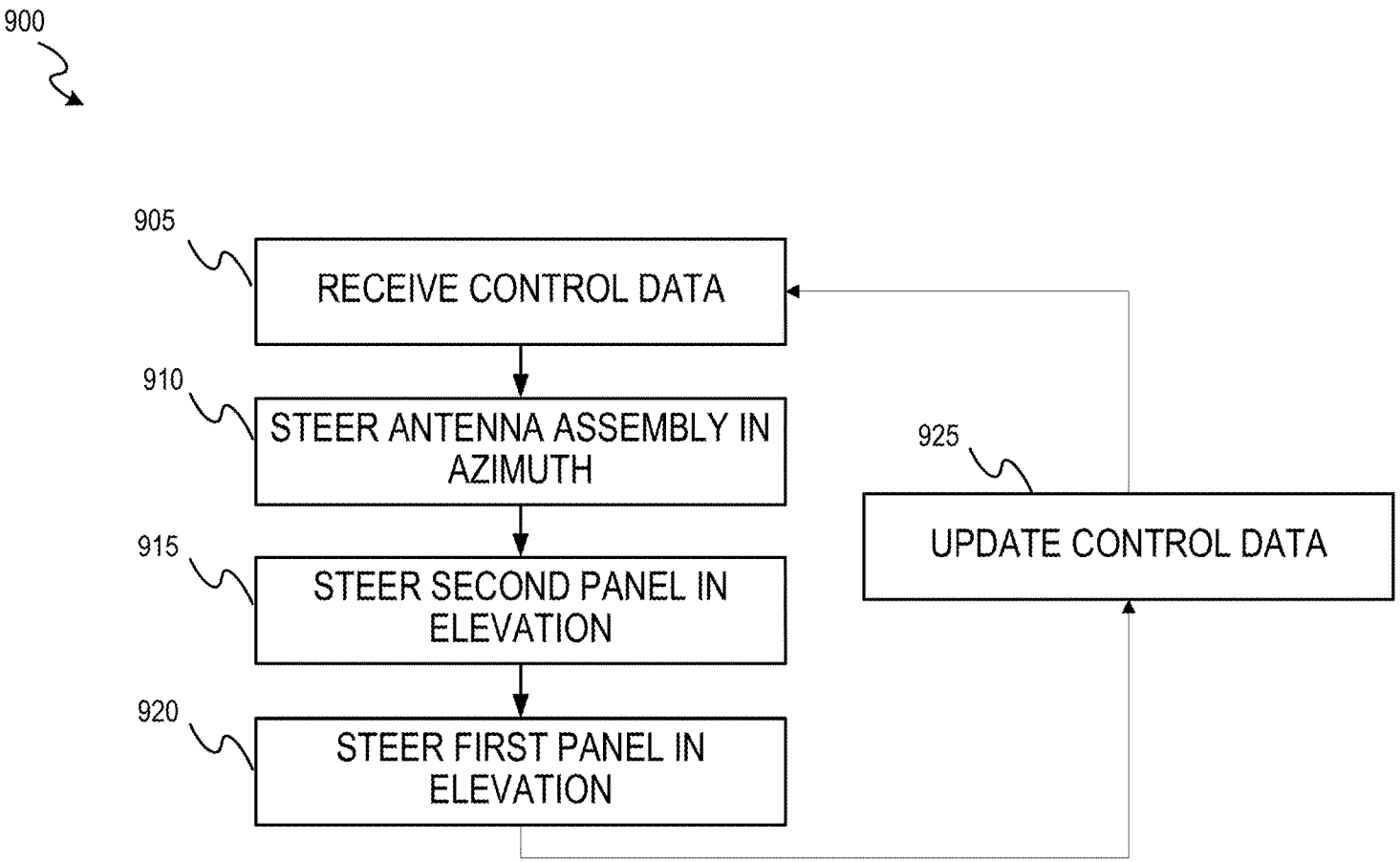
FIG. 9 is an example method flow for operating of the antenna assembly of FIGS. 6A-6C, in accordance with various aspects of the present disclosure.
Figure 10:
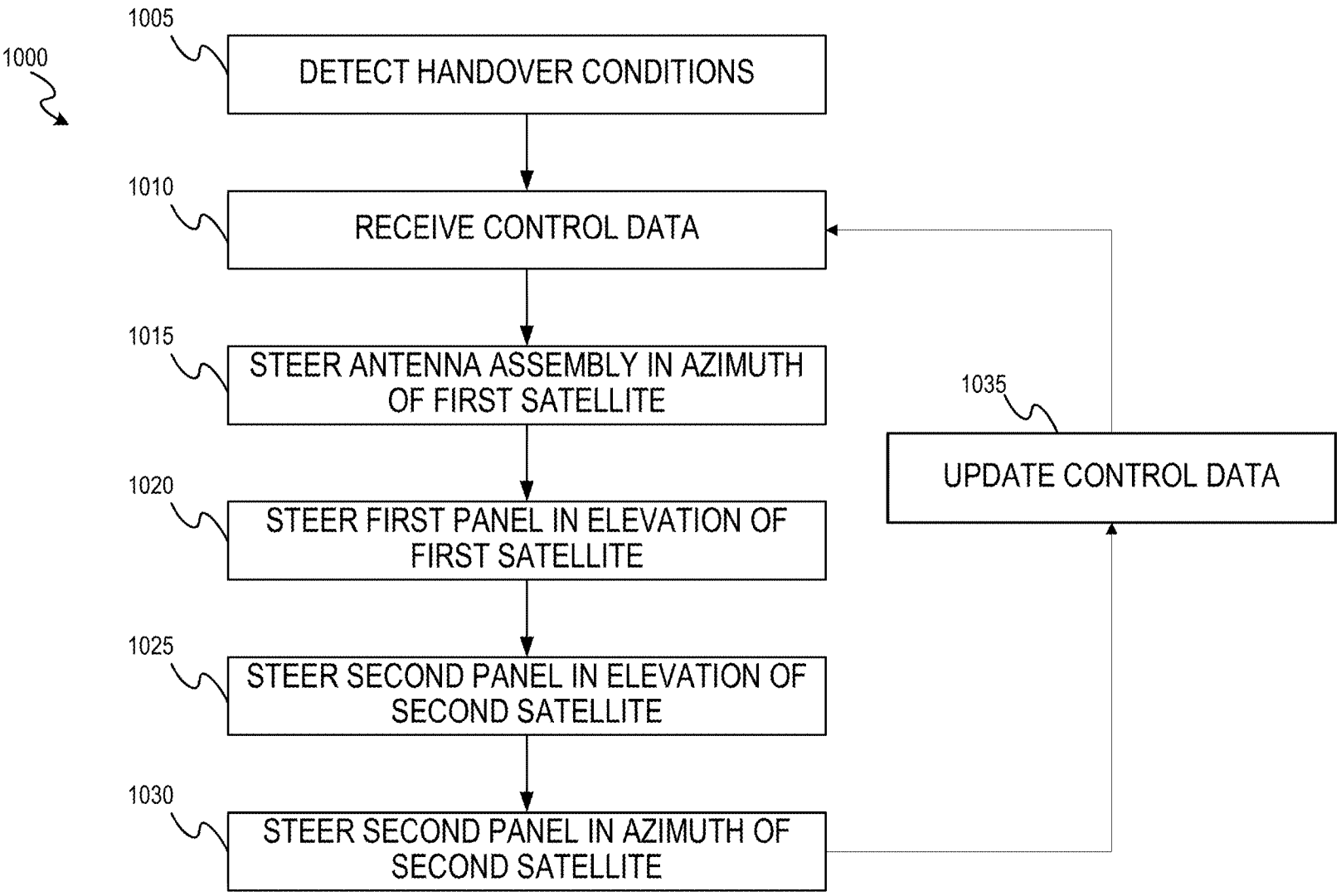
FIG. 10 is another example method flow for operating of the antenna assembly of FIGS. 6A-6C, in accordance with various aspects of the present disclosure.

FIGS. 9 and 10 are example method flows for the operation of the antenna assembly of FIGS. 6A-6C, in accordance with various aspects of the present disclosure. FIG. 9 provides process 900 for controlling the antenna assembly 600 a coverage region of a satellite system, such as satellite system 310*a*, approaches and passes by vehicle 111 (and thus system 100). FIG. 10 provides process 1000 for controlling the antenna assembly 600 while within overlapping regions of different satellite systems (e.g., a handover), such as satellite systems 310*a* and 310*b*. Processes 900 and 1000 may be performed by one or more devices and/or systems disclosed herein, such as, for example, system 100 illustrated in FIG. 1, discussed above. For example, processes 900 and/or 1000 may be executed in part or wholly by the antenna controller 830, transceiver system 130, antenna control system 500, vehicle position system 510, etc. Additionally, the processes need not occur in the sequential order illustrated and/or described below, but may occur in any desired order. Furthermore, one or more of the various process blocks may be executed in parallel with one or more of the other process blocks.

Turning to FIG. 9, while the vehicle 111 is within a coverage region of a satellite system 310*a*, the antenna system 128 communicatively couples the antenna assembly 600 to the satellite system 310*a* and the system 100.

At block 905, control data is received by the antenna assembly. For example, control data 490 as described herein may be provided by the antenna control system 500 to the antenna controller 830. The control data 490, as described herein, may include line-of-sight values, e.g., elevation, azimuth, and polarity information, beaming signals 124 to and receiving signals 122 from satellite system 310*a*. The line-of-sight values may be based, in part, on vehicle and satellite position data 515 and 520. The line-of-sight values are used to calculate a beam pointing direction aimed at the satellite system 310*a* on boresight and determine a configuration for the antenna assembly for achieving the determined beam pointing direction. The polarity information may be used to determine a polarity of antenna elements to align with the polarity of the satellite system 310*a*.

At block 910, the antenna assembly is steered in azimuth. For example, based on the control data from block 905, the antenna controller 830 uses the azimuth line-of-sight values for the satellite system 310*a* to determine the configuration servomotor 624 for steering the antenna assembly 600 to the azimuth aligned with the satellite system 310*a*. The determined configuration is communicated to the servomotor 624, which drives the rotatable plate 620 to align the front 608 of the antenna assembly 600 with the azimuth of the satellite system 310*a*. Accordingly, the beam pointing direction of panel 604 is aligned in azimuth with the satellite system 310*a* on boresight. In some embodiments, rotation of the rotatable plate 620 also aligns the beam pointing direction of the second panel 606 to the satellite system 310*a* in azimuth. As used herein, block 910 may be considered mechanically executed steering.

At block 915, the second panel 606 is steered in elevation. For example, based on the control data from block 905, the antenna controller 830 uses the elevation line-of-sight values for the satellite system 310*a* to determine the configuration servomotor 636 for steering the second panel 606 to the elevation aligned with the satellite system 310*a*. The determined configuration is communicated to the servomotor 636, which drives the pivot point 628 to rotate the second panel 606 about axis 632 and align beam pointing direction of the second panel 606 with the elevation of the satellite system 310*a*. As used herein, block 915 may be considered mechanically executed steering of the second panel 606.

At block 920, the first panel is steered in elevation. For example, based on the control data from block 905, the panel controller system 810 uses the elevation line-of-sight values (and in some embodiments the elevation line-of-sight values and polarity information) for the satellite system 310*a* to determine the configuration of each element ground 710 (and thus the antenna elements 618 thereof) of the first panel 604 for steering the beam pointing direction of panel 604 to the elevation of the satellite system 310*a*. The determined configuration is communicated to the group controller 818, which controls the respective antenna elements 618 of the element group 710 to steer the beam pointing direction and align the beam in with the elevation of the satellite system 310*a*. For example, the group controller 818 provides signals to each antenna element 618 of the group so to operate each of the antenna elements at a set phase and amplitude. Thus, the relative phase and amplitude of each antenna element 618 in an element group 710 are commonly operated such that, in receive and transmit directions, the beam pattern associated with the antenna panel may be steered a single plane or conic surface. Accordingly, the beam pointing direction of panel 604 is aligned in both elevation and azimuth with the satellite system 310*a* on boresight. As used herein, block 920 may be considered electrically executed steering of the second panel 606. In some embodiments, similar electrical steering of antenna elements 616 of the second panel 606 may be executed to align the beam pointing direction with the satellite system 310*a* in elevation and azimuth. In some embodiments, the panel control system 810 may also execute skew control, either at block 920 or separately at a prior or later process, based on polarity information for the satellite system 310*a*, for example, to align the polarity of the antenna elements for the first or second panel and/or second panel with the polarity of the satellite system 310*a*.

At optional block 925, the antenna assembly can optionally employ a feedback or closed-loop control system to update control data and maintain continuous alignment of the antenna assembly 600 with the satellite system 310*a*. For example, control data may be updated at block 925, based on reevaluating the vehicle and satellite position data to determine updated line-of-sight values. Additionally, signal strength of signals 124 received from the satellite system 310*a* may be included in the updated control data at block 925. The updated control data may be supplied to the antenna controller 830 as described in block 905 and process 900 is repeated continuously. Thus, the antenna assembly 600 is continuously orientated in alignment with the satellite system 310*a*. In some embodiments, the process 900 may be repeated until a contour boundary is detected, as described above, at which point, the antenna controller 830 may execute process 1000.

Process 900 may provide a non-limiting advantage by aligning both the first and second panels 604 and 606 to a single satellite system to provide increased bandwidth and improved performance. In some implementations, the performance may be doubled. For example, ganging the two panels 606 and 604 may increase both the gain-to-noise-temperature (G/T) (e.g., a measure of receive performance) and the equivalent isotropically radiated Power (e.g., the principal measure of transmit performance). The quantification of these improvements may depend on the exact implementation but can be in the order of 2-3 dB in either case.

Turning to FIG. 10, while multiple satellites travel by the vehicle 111, the vehicle may exit a first coverage region of first satellite system 310*a* and enter a second coverage region of a second satellite system 310*b*. Thus, the vehicle 111 may be present within overlapping coverage regions of satellite systems 310*a* and 310*b*. The process 1000 may be executed to align the antenna assembly 600 with both satellite systems simultaneously. In such scenarios, steering on a first satellite system 310*a* can be maintained continuously, while one of the panels (e.g., one of panels 604 and/or 606) moves away from the first satellite systems 310*a* and repositions on the second satellite systems 310*b*. As described above, process 1000 need not be occur in the sequential order illustrated and/or described below, but may occur in any desired order. Furthermore, the antenna assembly 600 provides increased angle ranges for respective beam pointing directions, thereby facilitating wider possible separation between beam pointing directions. Advantageously, the antenna assembly 600 is capable of communication with any combination of LEO, MEO, GEO, or HAPS satellite systems simultaneously and reduced heat dissipation as compared to conventional systems.

At block 1005 a handover condition is detected. For example, a contour boundary of a coverage region may be detected approaching the position of the vehicle 111. Alternatively or in combination, the system 100 may detect that that vehicle 111 is present in overlapping coverage regions and/or detect the signals from a second satellite system 310*b* are stronger than signals from a first satellite system 310*a*.

Once handover conditions are detected at block 1005, control data is received by the antenna assembly at block 1010. For example, control data 490 as described herein may be provided by the antenna control system 500 to the antenna controller 830. The control data 490, as described herein, may include line-of-sight values, e.g., elevation, azimuth, and polarity information, beaming signals 124 to and receiving signals 122 from first satellite system 310*a* and second satellite system 310*a*. The line-of-sight values may be based, in part, on vehicle and satellite position data 515 and 520. The line-of-sight values are used to calculate a beam pointing direction aimed at the satellite system 310*a* on boresight and determine a configuration for the antenna assembly for achieving the determined beam pointing direction. The polarity information may be used to determine a polarity of antenna elements to align with the polarity of the satellite system 310*a*.

At block 1015, the antenna assembly is steered in azimuth of the first satellite system. For example, based on the control data from block 1010, the antenna controller 830 uses the azimuth line-of-sight values for the first satellite system 310*a* to determine the configuration servomotor 624 for steering the antenna assembly 600 to the azimuth aligned with the first satellite system 310*a*. The determined configuration is communicated to the servomotor 624, which drives the rotatable plate 620 to align the front 608 of the antenna assembly 600 with the azimuth of the first satellite system 310*a*. Accordingly, the beam pointing direction of the first panel 604 is aligned in azimuth with the first satellite system 310*a* on boresight. As used herein, block 1015 may be considered mechanically executed steering.

At block 1020, the first panel is steered in elevation of the first satellite system. For example, based on the control data from block 1010, the panel controller system 810 uses the elevation line-of-sight values (and, in some embodiments, the elevation line-of-sight values and the polarity information) for the first satellite system 310*a* to determine the configuration element group 710 (and thus the antenna elements 618) of the first panel 604 for steering the beam pointing direction of the first panel 604 to the elevation of the first satellite system 310*a*. The determined configuration is communicated to the group controller 818, which controls the respective element group 710 to steer the beam pointing direction and align to the elevation of the first satellite system 310*a*. For example, the group controller 818 provides signals to each antenna element 618 of the group so to operate each of the antenna elements at a set phase and amplitude. Thus, the relative phase and amplitude of each antenna element 618 in an element group 710 are commonly operated such that, in receive and transmit directions, the beam pattern associated with the antenna panel may be steered a single plane or conic surface. Accordingly, the beam pointing direction of first panel 604 is aligned in both elevation and azimuth with the first satellite system 310*a* on boresight. As used herein, block 1020 may be considered electrically executed steering of the first panel 604. In some embodiments, the panel control system 810 of the first panel 604 may also execute skew control, either at block 1020 or separately at a prior or later process, based on polarity information for the satellite system 310*a*, for example, to align the polarity of the antenna elements 618 for the first panel 604 with the polarity of the satellite system 310*a*.

At block 1025, the second panel is steered in elevation of the second satellite system. For example, based on the control data from block 1010, the antenna controller 830 uses the elevation line-of-sight values for the second satellite system 310*b* to determine the configuration servomotor 636 for steering the second panel 606 to the elevation aligned with the second satellite system 310*b*. The determined configuration is communicated to the servomotor 636, which drives the pivot point 628 to rotate the second panel 606 about axis 632 and align beam pointing direction of the second panel 606 with the elevation of the second satellite system 310*b*. As used herein, block 1025 may be considered mechanically executed steering of the second panel 606.

At block 1030, the second panel is steered in azimuth. For example, based on the control data from block 1010, the panel controller system 820 uses the azimuth line-of-sight values (and in some embodiments the azimuth line-of-sight values and the polarity information) for the second satellite system 310*b* to determine the configuration element group 720 (and thus the antenna elements 616) of the second panel 606 for steering the beam pointing direction of the second panel 606 to the azimuth of the second satellite system 310*b*. The determined configuration is communicated to the group controller 826, which controls the respective array 720 to steer the beam pointing direction and align to the azimuth of the second satellite system 310*a*. For example, the group controller 826 provides signals to each antenna element 616 of the group so to operate each of the antenna elements at a set phase and amplitude. Thus, the relative phase and amplitude of each antenna element 616 in an element group 720 are commonly operated such that, in receive and transmit directions, the beam pattern associated with the antenna panel may be steered a single plane or conic surface. Accordingly, the beam pointing direction of the second panel 606 is aligned in both elevation and azimuth with the second satellite system 310*b* on boresight. As used herein, block 1030 may be considered electrically executed steering of the second panel 606. In some embodiments, the panel control system 820 of the second panel 606 may also execute skew control, either at block 1030 or separately at a prior or later process, based on polarity information for the satellite system 310*b*, for example, to align the polarity of the antenna elements 616 for the second panel 606 with the polarity of the satellite system 310*b*.

At block 1035, the antenna assembly can optionally employ a feedback or closed-loop control system to update control data and maintain continuous alignment of the antenna assembly 600 with the first satellite system 310*a* and second satellite system 310*b*. For example, control data may be updated at block 1035 based on reevaluating the vehicle and satellite position data to determine updated line-of-sight values. Additionally, signal strength of signals 124 received from both satellite systems 310*a* and 310*b* may be included in the updated control data at block 1035. The updated control data may be supplied to the antenna controller 830 as described in block 1010 and process 1000 is repeated continuously. Thus, the antenna assembly 600 is continuously orientated in alignment with the both satellite systems 310*a* and 310*b* simultaneously in real-time. In some embodiments, the process 1000 may be repeated until handover conditions are no longer present, at which point, the antenna controller 830 may execute process 900 using the second satellite system 310*b*. In various embodiments, the only necessary feedback may be provided to tell the antenna controller when a panel has been moved out of alignment and when it is back in alignment.

In various embodiments, after the second satellite system 310*b* has been acquired, and the antenna controller 830 has confirmed this, the first panel 604 may be steered onto the second satellite system 310*b*.

While process 1000 is described having first panel 604 steered to first satellite system 310*a* and then moving to second satellite system 310*b*, it will be appreciated that the reverse is equally applicable. That is second panel 606 may be steered to the first satellite system 310*a*, a handover condition is detected, and the first panel 604 is steered to the second satellite system 310*b* to affect a soft handover. Once the satellite system 310*b* has been acquired, the second panel 606 may be steered onto the second satellite system 310*b*.

Figure 11:
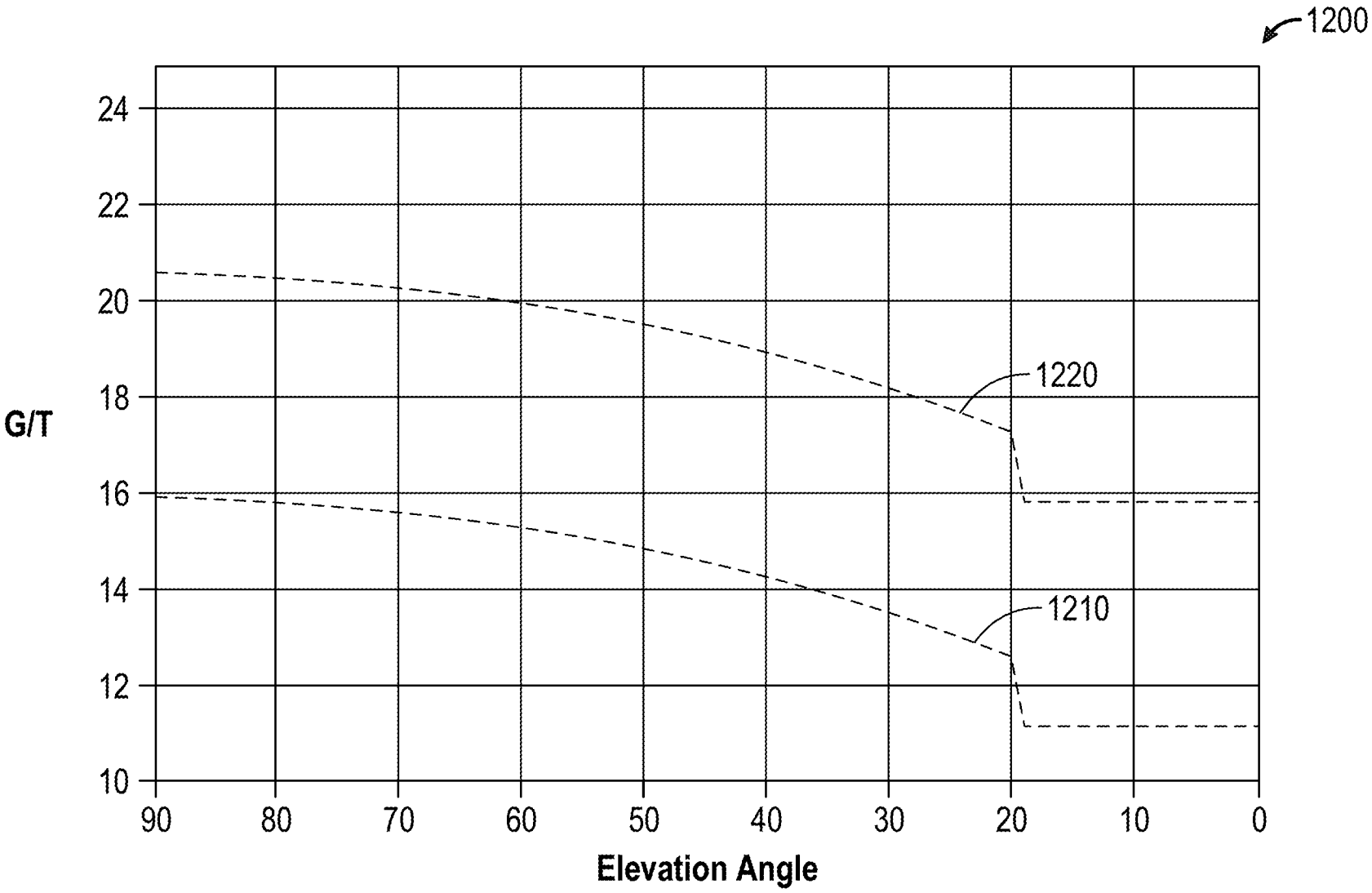
FIG. 11 illustrates an example graph of antenna gain-to-noise-temperature as a function of elevation angle.

FIG. 11 illustrates an example graph of antenna gain-to-noise-temperature as a function of elevation angle. The graph 1100 depicts gain-to-noise-temperature (G/T) of embodiments of the antenna assembly described herein as a function of elevation angle of a vehicle on which the antenna system is installed measured at two different frequencies. For example, line 1110 illustrates G/T results for embodiments of the antenna system described herein simulated at a frequency within the $K_u$-Band (e.g., 11.7 GHz) and line 1120 illustrates G/T results simulated at a frequency within the K-$K_a$ Band (e.g., 20 GHz).

For communication with GEO satellites in the $K_u$ band and providing a satisfactory communication experience for passengers on wide-body aircraft and smaller, a G/T of at least 9 dB/K is preferable, and more preferably a G/T of at least 10 dB/K, even for circular polarizations at lower elevations scans, e.g., from 10 up to 30 degrees, and more preferably at least 10.5 dB/K. For higher elevations scans, e.g., from at least 30 degrees to 90 degrees, G/T is preferably at least 11 dB/K, more preferably at least 11.5 dB/K, and even more preferably at least 12.5 dB/K. Thus, generally a G/T between approximately 11 and approximately 16 dB/K is preferable for communications in the $K_u$ Band. For communications in the $K_a$-Band, a G/T of between approximately 16 and approximately 21 dB/K may be preferred. The constellations for LEO and MEO satellites, for example, generally designed so that the look angles are no greater than about 45 to 50 degrees from the zenith.

Accordingly, the simulated results shown in graph 1100 depict the advantages of the antenna assemblies described herein to provide the preferred G/T for communication with various satellite systems. For example, as illustrated by line 1110, a weighted average G/T of approximately 13.3 dB/K and an EIRP of approximately 48 dBW are achieved when the antenna assembly is operated at 11.7 GHz. Similarly, as illustrated by line 1120, a weighted average G/T of approximately 18 dB/K and an EIRP of approximately 48 dBW are achieved when the antenna assembly is operated at 20 GHz. Both simulations provided power consumption of approximately 350 W, which meets the ARINC 791 standard.

Figure 12A:
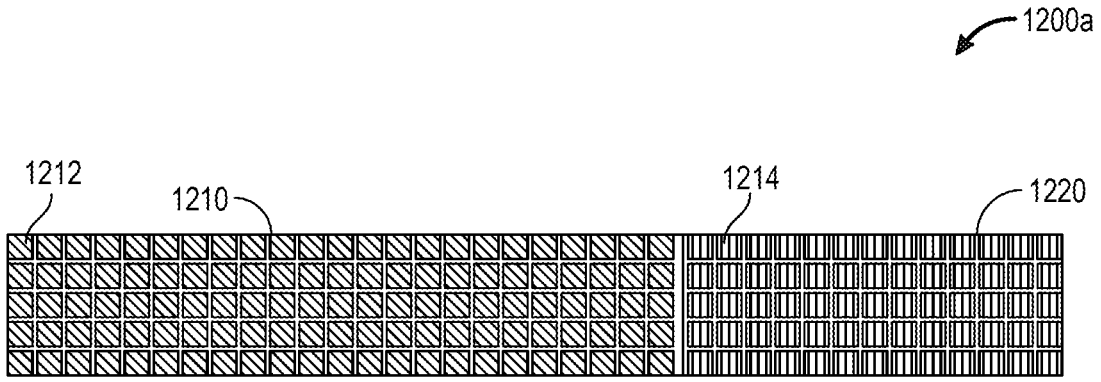
FIGS. 12A and 12B schematically illustrate embodiments of phased arrays installable on the antenna assembly of FIGS. 6A-6E, in accordance with various aspects of the present disclosure.
Figure 12B:
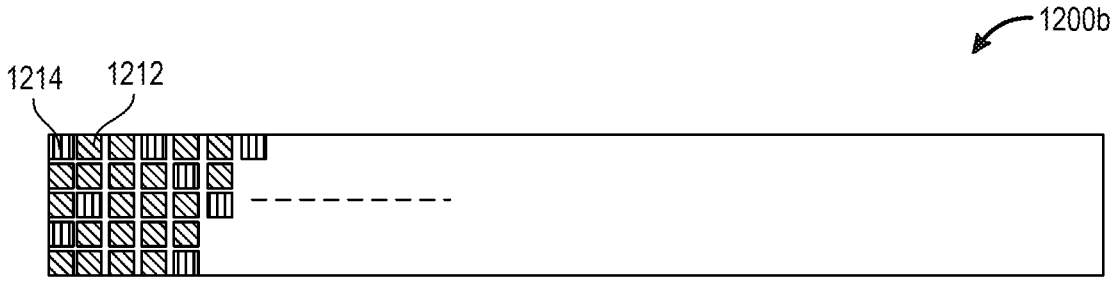

FIGS. 12A and 12B schematically illustrate embodiments of phased arrays installable on the antenna assembly of FIGS. 6A-6E, in accordance with various aspects of the present disclosure. FIGS. 12A and 12B illustrate panels 1200*a* and 1200*b* comprising a plurality of antenna elements 1212 and 1214 for duplex operation. Panels 1200*a* and 1200*b* may be implemented as panels 606 and/or 604. Antenna elements 1212 and/or 1214 may correspond to antenna elements 618 and/or 616 described herein.

FIG. 12A depicts an example panel 1200*a* configured for duplex operation through a straight split along the virtual split line 1205. Panel 1200*a* is split into two separate regions, a first region comprising a first array 1210 of antenna elements 1212 and a second region comprising a second array 1220 of antenna elements 1214. The first array 1210 may be configured for receiving signals 122 from a satellite system (e.g., satellite system 310*a* and/or 310*b*), while the other array 1220 may be configured for transmitting signals 124 to a satellite system. In some embodiments, the panel 1200*a* may provide a beam width of approximately 1.2 degrees, an average receiver G/T of approximately 16.5, and an equivalent isotopically radiated power (EIRP) of approximately 49 dBW.

FIG. 12B depicts an example panel 1200*b* configured for duplex operation through a spreading code to distribute the antenna elements 1212 and 1214 amongst each other. As with FIG. 12A, panel 1200*b* is split into two separate operations, the antenna elements 1212 are configured to receive signals 122 from a satellite system and the antenna elements 1214 are configured to transmit signals 124 to the satellite system. In some embodiments, the majority of the antenna elements for a panel are antenna elements 1212 for receiving signals, which gives a receiver performance that is closer to what is obtained if the all the antenna elements were configured for receiving. Antenna elements 1214 are spread around in a mathematical pattern configured to optimize the beam width and side lobe performance. Accordingly, in some embodiments, the panel 1200*b* may provide an average receiver G/T of approximately 17 dB/K and an EIRP of approximately 50 dBW when configured to $K_a$-Band operation.

Figure 13:
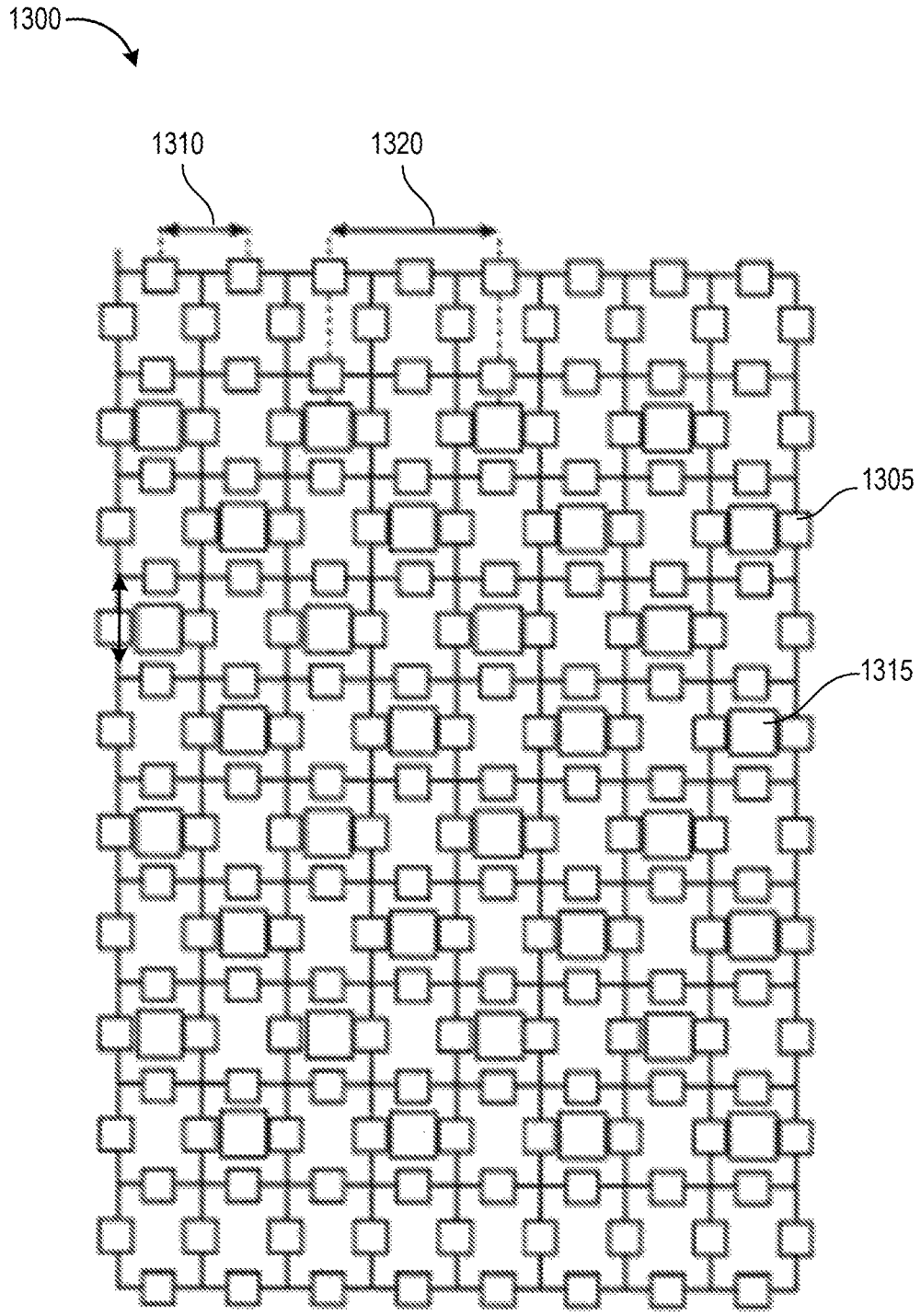
FIG. 13 illustrates an alternative array arrangement for antenna elements divided into first and second arrays for communicating in different bands, in accordance with various aspects of the present disclosure.

FIG. 13 illustrates an alternative array arrangement for antenna elements divided into first and second arrays for communicating in different bands, in accordance with various aspects of the present disclosure, such as $K_u$ and $K_a$.

In one example, FIG. 13 illustrates an example arrangement of elements 1305 and 1315 representing antenna elements 618 and/or 616 of a panel. Smaller elements 1305 may be spaced closer together at spacing 1310 for accommodating one band (e.g., less than one-half of the wavelength of the one band). Larger elements 1315 may be inserted among the smaller elements at a greater spacing 1320 from one another to accommodate a different band (e.g., less than one-half of the wavelength of the different band). Thus, a single panel may be configured for multi-band operation.

Figure 14:
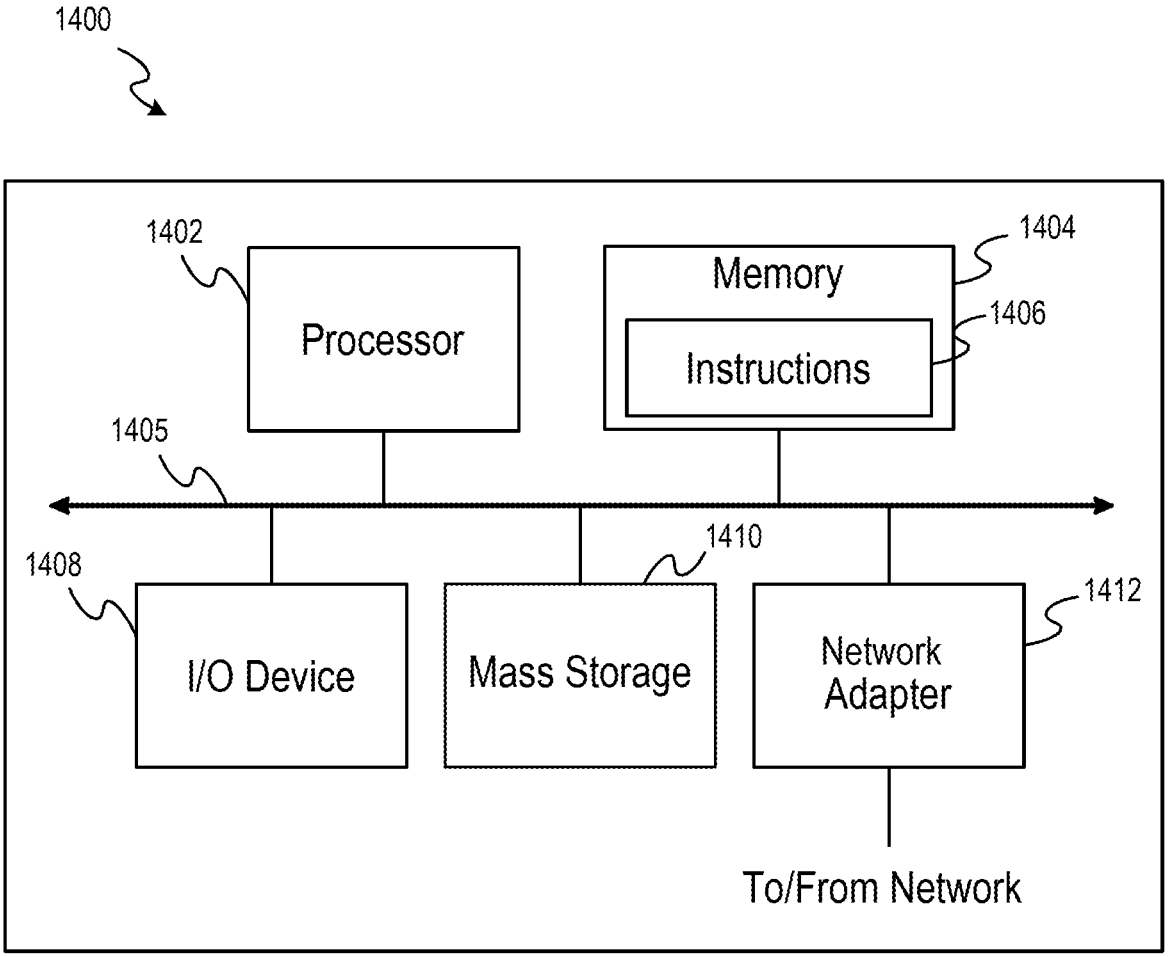
FIG. 14 illustrates a block diagram of a computing system, in accordance with various aspects of the present disclosure.

FIG. 14 illustrates a block diagram of a computing system, in accordance with various aspects of the present disclosure. FIG. 14 is a high-level block diagram showing an example of the architecture of a processing system 1400 that may be implemented as any one or more of the components of embodiments described herein. The processing system 1400 can represent one or more of server system 118, computer system 136, information system controller 119, antenna control system 500, antenna controller 830, panel controller systems 810 and/or 820, or other systems and components of the system 100. Note that certain standard and well-known components which are not germane to the present aspects are not shown in FIG. 14.

The processing system 1400 includes one or more processor(s) 1405 and memory 1404, coupled to a bus system 1405. The bus system 1405 shown in FIG. 14 may be an abstraction that represents any one or more separate physical buses and/or point-to-point connections, connected by appropriate bridges, adapters and/or controllers. The bus system 1405, therefore, may include, for example, a system bus, a Peripheral Component Interconnect (PCI) bus, a HyperTransport or industry standard architecture (ISA) bus, a small computer system interface (SCSI) bus, a universal serial bus (USB), or an Institute of Electrical and Electronics Engineers (IEEE) standard 1366 bus (sometimes referred to as "Firewire") or any other interconnect type. The bus system 1405 may also be representative of one or more of the bus lines described above in connection to FIG. 8.

The processor(s) 1402 are the central processing units (CPUs) of the processing system 1400 and, thus, control its overall operation. In certain aspects, the processors 1402 accomplish this by executing software stored in memory 1404. A processor 1402 may be, or may include, one or more programmable general-purpose or special-purpose microprocessors, digital signal processors (DSPs), programmable controllers, application specific integrated circuits (ASICs), programmable logic devices (PLDs), or the like, or a combination of such devices. In various embodiments, for example, the DSP circuit 832 may be implemented as processor(s) 1402.

Memory 1404 represents any form of random access memory (RAM), read-only memory (ROM), flash memory, or the like, or a combination of such devices. Memory 1404 includes the main memory of the processing system 1400. Instructions 1406 may be used to implement the functions and processes described above, for example, in FIGS. 4, 5, 9, and 10. The memory 1404 may be coupled to the processor 1402, and the processor 1402 may be configured to execute instructions (e.g., software) stored in the memory 1404 to carry out the various aspects of the universal portal system described herein.

Also connected to the processors 1402 through the bus system 1405 are one or more internal mass storage devices 1410, and a network adapter 1412. Internal mass storage devices 1410 may be, or may include any conventional medium for storing large volumes of data in a non-volatile manner, such as one or more magnetic or optical based disks, flash memory, or solid-state drive.

The network adapter 1412 provides the processing system 1400 with the ability to communicate with devices and or external systems (e.g., over a network) and may be, for example, an Ethernet adapter, USB ports, optical fiber ports, or the like.

The processing system 1400 also includes one or more input/output (I/O) devices 1408 coupled to the bus system 1405. The I/O devices 1408 may include, for example, a display device, a touch screen device, a microphone for voice commands, a camera for detecting gestures and other non-tactile inputs, a keyboard, a mouse, etc. The I/O device may be in the form of a handset having one or more of the foregoing components, such as a display with a real or virtual keyboard, buttons, and/or other touch-sensitive surfaces.

Although particular embodiments have been shown and described, it is to be understood that the above description is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, not all of the components described in the embodiments are necessary, and the invention may include any suitable combinations of the described components, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more.

The various illustrative logical or functional blocks and algorithm operations described in connection with the embodiments disclosed herein may be implemented as electronic hardware, computer software, or combinations of both. To clearly illustrate this interchangeability of hardware and software, various illustrative components, blocks, modules, and operations have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the present inventive concept.

The hardware used to implement the various illustrative blocks and modules described in connection with the various embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of receiver devices, e.g., a combination of a DSP and a microprocessor, a plurality of microprocessors, one or more microprocessors in conjunction with a DSP core, or any other such configuration. Alternatively, some operations or methods may be performed by circuitry that is specific to a given function.

What is claimed is:

1. An antenna assembly comprising:

a rotatable plate rotatable about a first axis, wherein rotation of the rotatable plate about the first axis steers the antenna assembly in azimuth;

a first panel affixed to the rotatable plate, the first panel comprising a first plurality of phased array antenna elements configured to steer a first beam of radio waves in elevation;

a mounting structure adjacent to the first panel, the mounting structure having a proximal end mounted to the rotatable plate, a distal end, and a pivot point between the proximal end and the distal end, the distal end being rotatable about a second axis perpendicular to the first axis at the pivot point; and a second panel disposed at the distal end of the mounting structure, the second panel comprising a second plurality of phased array antenna elements configured to steer a second beam of radio waves in azimuth, wherein rotation of the distal end about the second axis steers the second beam of radio waves in elevation;

wherein the first plurality of phased array antenna elements are configured to steer the first beam of radio waves in a first virtual plane that is parallel to the first axis; and wherein the second plurality of phased array antenna elements are configured to steer the second beam of radio waves in a second virtual plane that is parallel to the second axis.

2. The antenna assembly of claim 1, wherein the first plurality of phased array antenna elements are configured to steer the first beam at an azimuth angle based on a first rotation angle of the rotatable plate about that first axis; and the second plurality of phased array antenna elements are configured to steer the second beam at an elevation angle that is based on a rotation angle of the second panel about that second axis.

3. The antenna assembly of claim 1, further comprising an antenna controller communicatively coupled to the first plurality of phased array antenna elements, the antenna controller configured to selectively operate the first plurality of phased array antenna elements to electrically steer the first beam of radio waves in elevation.

4. The antenna assembly of claim 1, further comprising an antenna controller communicatively coupled to the second plurality of phased array antenna elements, the antenna controller configured to selectively operate the second plurality of phased array antenna elements to electrically steer the second beam of radio waves in azimuth.

5. The antenna assembly of claim 1, further comprising an antenna controller communicatively coupled to a first motor coupled to the rotatable plate, the antenna controller configured to drive the first motor to mechanically rotate the rotatable plate about the first axis and steer at least the first beam of radio waves in azimuth.

6. The antenna assembly of claim 1, further comprising an antenna controller communicatively coupled to a second motor coupled to the mounting structure, the antenna controller configured to drive the second motor to mechanically pivot the second panel about the second axis and mechanically steer the second beam of radio waves in elevation.

7. The antenna assembly of claim 1, wherein rotation of the rotatable plate about the first axis steers the antenna assembly to align with a first satellite system in azimuth.

8. The antenna assembly of claim 7, wherein the first beam of radio waves of the first plurality of phased array antenna elements are steered to align with the first satellite system in elevation.

9. The antenna assembly of claim 7, wherein rotation of the second panel about the pivot point steers the second panel to align with the first satellite system in elevation.

10. The antenna assembly of claim 7, wherein rotation of the second panel about the pivot point steers the second panel to align with a second satellite system in elevation.

11. The antenna assembly of claim 10, wherein the second beam of radio waves of the second plurality of phased array antenna elements are steered to align with the second satellite system in azimuth.

12. The antenna assembly of claim 11, wherein the first beam of radio waves of the first plurality of phased array antenna elements are steered to the first satellite system and the second beam of radio waves of the second plurality of phased array antenna elements are steered to the second satellite system simultaneously.

13. The antenna assembly of claim 11, wherein one or more of the first satellite system and the second satellite system comprise one of a geostationary orbit satellite, a medium earth orbit satellite system, a low earth orbit satellite system, and a high-altitude pseudo satellite (HAPS) systems satellite.

14. The antenna assembly of claim 1, wherein the first panel comprises a first plurality of element groups each comprising a subset of antenna elements of the first plurality of phased array antenna elements, wherein, for each of the first plurality of element groups, the antenna controller is configured to operate the respective antenna elements at common operating parameters.

15. The antenna assembly of claim 1, wherein the second panel comprises a second plurality of element groups each comprising a subset of antenna elements of the second plurality of phased array antenna elements, wherein, for each of the second plurality of element groups, the antenna controller is configured to operate the respective antenna elements at common operating parameters.

16. The antenna assembly of claim 1, wherein at least one of the first panel and the second panel comprises a first subset of phased array antenna elements configured to communicate in a first frequency band and a second subset of phased array antenna elements configured to communicate in a second frequency band.

* * * * *